US007658458B2

(12) United States Patent
Iwao et al.

(10) Patent No.: US 7,658,458 B2
(45) Date of Patent: Feb. 9, 2010

(54) INKJET RECORDING APPARATUS AND METHOD OF DETERMINING CONTROL CONDITION IN THE APPARATUS

(75) Inventors: Naoto Iwao, Nagoya (JP); Manabu Hibi, Nagoya (JP); Kenichi Satake, Osaka (JP); Shin Ishikura, Kirishima (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 134 days.

(21) Appl. No.: 11/693,709

(22) Filed: Mar. 29, 2007

(65) Prior Publication Data

US 2007/0229561 A1 Oct. 4, 2007

(30) Foreign Application Priority Data

Mar. 30, 2006 (JP) ..... 2006-094777

(51) Int. Cl.
*B41J 29/38* (2006.01)

(52) U.S. Cl. ..... 347/10; 347/11; 347/13

(58) Field of Classification Search ..... 347/10–11, 347/5, 9, 12, 13
See application file for complete search history.

(56) References Cited

U.S. PATENT DOCUMENTS 6,102,512 A * 8/2000 Torii et al. ..... 347/10
6,350,003 B1 2/2002 Ishikawa
6,808,254 B2 10/2004 Sakaida et al.
2004/0095404 A1 * 5/2004 Iwao et al. ..... 347/10

FOREIGN PATENT DOCUMENTS

EP 0738598 A2 10/1996
EP 1772268 A2 4/2007
JP 2003-305852 A 10/2003

OTHER PUBLICATIONS

European Patent Office, European Search Report for Related EP Application No. 07251445, mailed Jul. 27, 2007.

* cited by examiner

*Primary Examiner*—Lam S Nguyen
(74) *Attorney, Agent, or Firm*—Baker Botts L.L.P.

(57) ABSTRACT

An actuator can selectively switch a volume of a pressure chamber between a first state V1 and a second state V2, which is greater than V1. The actuator changes from the first state into the second state and then changes back into the first state to eject ink from an ejection port. A controller controls the actuator such that To/Tc falls within a range from 0.51 to 0.54. To represents the time period between time the actuator starts to change from the first state into the second state, to a time the actuator starts to change from the second state into the first state. Tc represents the period of proper oscillation of ink filling up the individual ink passage. The actuator is controlled so that a variation in ink ejection speed is prevented from being too large relative to the variation in the degree of deformation of the actuator.

4 Claims, 12 Drawing Sheets

INKJET RECORDING APPARATUS AND METHOD OF DETERMINING CONTROL CONDITION IN THE APPARATUS

CROSS-REFERENCE TO RELATED APPLICATION

This application claims priority to and the benefit of Japanese Patent Application No. 2006-094777, which was filed on Mar. 30, 2006, the disclosure of which is incorporated herein by reference.

BACKGROUND OF THE INVENTION

1. Field of the Invention

The present invention relates to an inkjet recording apparatus, in particular, using a so-called fill-before-fire method for ink ejection.

2. Description of Related Art

An inkjet recording apparatus that ejects ink by an inkjet system has the following construction. The inkjet recording apparatus includes therein an inkjet head on which nozzles are formed for ejecting ink. Ink is supplied to the respective nozzles from a common ink chamber formed in the inkjet head. For this purpose, individual ink passages leading from the common ink chamber to the respective nozzles are formed in the inkjet head. For each individual ink passage, an actuator is provided in the inkjet head for applying a pressure to ink in the individual ink passage. Part of ink to which the pressure has been applied by deformation of the actuator is ejected from the corresponding nozzle.

At that time, a pressure wave is generated by applying the pressure to ink in the pressure chamber, and as a result, proper oscillation is generated in the individual ink passage due to the pressure wave. Japanese Patent Unexamined Publication No. 2003-305852 discloses an inkjet head that efficiently ejects ink by using peaks of such proper oscillation. The inkjet head of the publication adopts a so-called fill-before-fire method in which the volume of each pressure chamber is once increased and then the pressure chamber is restored to its original volume after a predetermined time elapses, to apply a pressure to ink in the pressure chamber.

Deformations of such actuators involve various kinds of variations such as manufacturing variations. For example, a case will be discussed wherein an actuator is deformed by supplying a voltage signal to the actuator. In this case, when a voltage signal having therein a difference in voltage is supplied, all actuators are not deformed exactly as designed to correspond to the difference in voltage. As a result, the degree of deformation of an actuator may be a little shifted from its designed value. This causes a shift of the ejection speed of ink from the designed ejection speed when the ink is ejected from the corresponding nozzle by the deformation of the actuator.

When ink is ejected from an inkjet head using a fill-before-fire method as disclosed in the above publication, some shapes of individual ink passages may cause a too large shift of the ink ejection speed relative to the shift of the degree of deformation of the corresponding actuator When the ink ejection speeds are thus largely shifted relatively to the shifts of the respective actuators, the ink ejection speed widely varies from actuator to actuator or from ink ejection to ink ejection. When the ink ejection speeds are largely shifted, variation in ink ejection speed is wide relatively to variation in the degree of actuator deformation. This may cause a reduction of the reproducibility of an image to be formed on a printing paper.

SUMMARY OF THE INVENTION

An object of the present invention is to provide an inkjet recording apparatus wherein variation in ink ejection speed has been suppressed relatively to variation in the degree of actuator deformation, and a method of determining a control condition in the apparatus.

According to an aspect of the present invention, an inkjet recording apparatus comprises a passage unit comprising a common ink chamber and an individual ink passage leading from an outlet of the common ink chamber via a pressure chamber to an ink ejection port; an actuator that can selectively take a first state in which the volume of the pressure chamber is V1 and a second state in which the volume of the pressure chamber is V2 larger than V1; and a controller that controls the actuator to change from the first state into the second state and then change back into the first state to eject ink from the ejection port. The individual ink passage is formed so as to satisfy both of the following conditions: (a) a curved line representing a change in the ejection speed of ink to be ejected from the ejection port, relative to a change in the time period To from a time point at which the actuator starts to change from the first state into the second state, to a time point at which the actuator starts to change from the second state into the first state, when the actuator changes from the first state into the second state and then changes back into the first state to eject ink from the ejection port, has a general shape being convex in the direction of the ejection speed increasing; and. (b) the ink ejection speed takes at least one maximal value on the curved line in a region in which To is larger than ½ times the period Tc of proper oscillation of ink filling up the individual ink passage. The controller controls the actuator such that the value of To/Tc falls within a range from 0.51 to 0.54.

According to the invention, the actuator is controlled such that the value of To/Tc falls within the range from 0.51 to 0.54. Therefore, as will be understood from the analysis that will be described later, variation in ink ejection speed is prevented from becoming too large relatively to variation in the degree of deformation of the actuator. This prevents the reproducibility of an image to be printed, from being beyond the bounds of permissibility.

According to another aspect of the present invention, a method of determining a control condition in an inkjet recording apparatus is provided. The apparatus comprises a passage unit comprising a common ink chamber and an individual ink passage leading from an outlet of the common ink chamber via a pressure chamber to an ink ejection port; an actuator that can selectively take a first state in which the volume of the pressure chamber is V1 and a second state in which the volume of the pressure chamber is V2 larger than V1; and a controller that controls the actuator to change from the first state into the second state and then change back into the first state to eject ink from the ejection port. The individual ink passage is formed so as to satisfy the following condition. (a) a curved line representing a change in the ejection speed of ink to be ejected from the ejection port, relative to a change in the time period To from a time point at which the actuator starts to change from the first state into the second state, to a time point at which the actuator starts to change from the second state into the first state, when the actuator changes from the first state into the second state and then changes back into the first state to eject ink from the ejection port, has a general shape being convex in the direction of the ejection speed increasing; and (b) the ink ejection speed takes at least one maximal value on the curved line in a region in which To is larger than ½ times the period Tc of proper oscillation of ink filling up the individual ink passage. The method comprises a condition determining step of determining a control condition for the controller controlling the actuator such that To is longer than ½ times the period Tc of proper oscillation of ink filling up the individual ink passage, and causes the ink ejection speed not to take the maximal value on the curved line.

According to the invention, a control condition for the actuator is determined so that variation in ink ejection speed does not become too large relatively to variation in the degree of deformation of the actuator.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a preferred embodiment of the present invention and results of analysis by the inventors of the present invention will be described with reference to the accompanying drawings.

Figure 1:
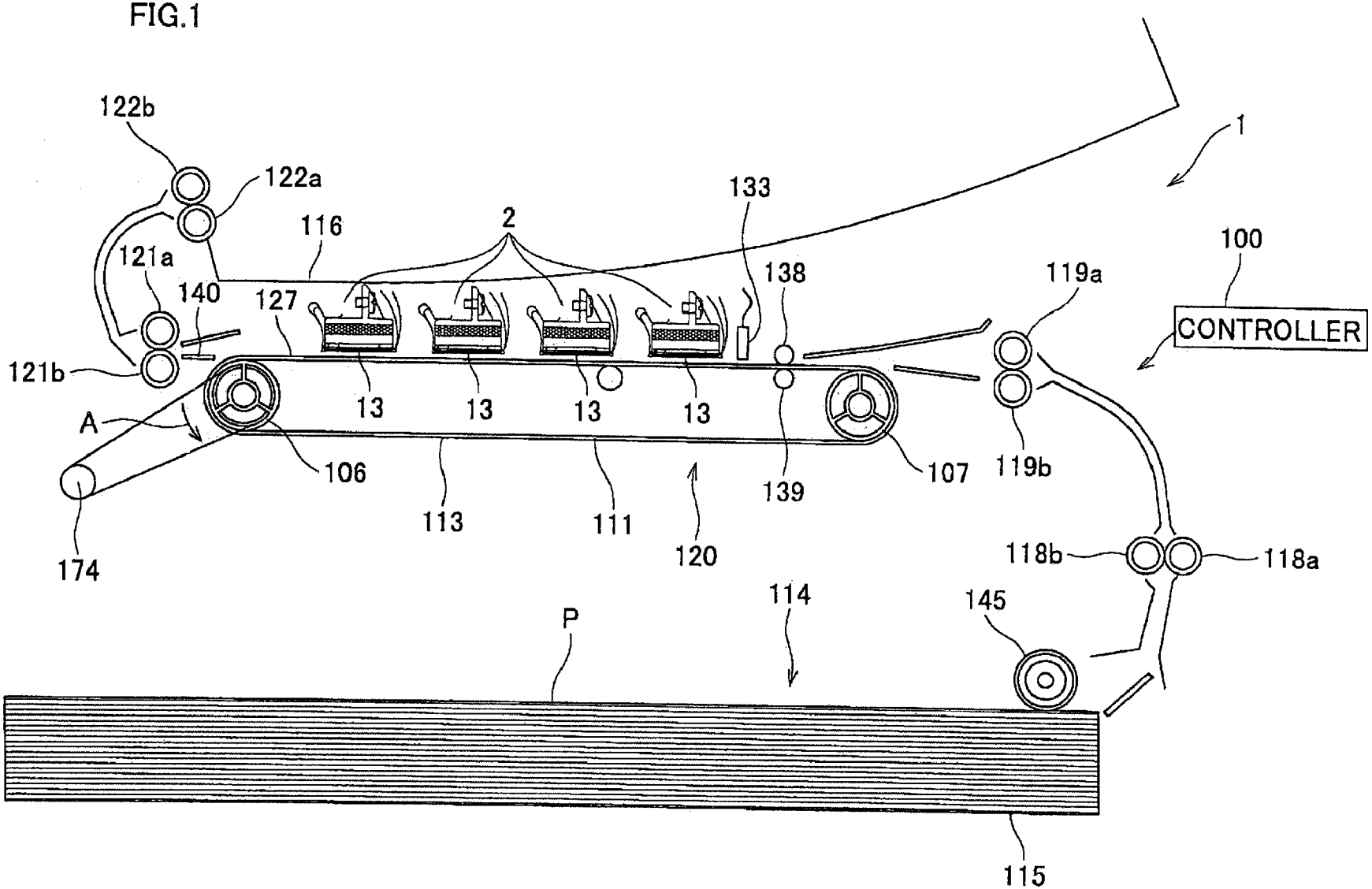
FIG. 1 shows a general construction of a printer as an inkjet recording apparatus according to an embodiment of the present invention.

FIG. 1 shows a general construction of a color inkjet printer according to an embodiment of the present invention. The printer 1 includes therein four inkjet heads 2. The inkjet heads 2 are fixed to the printer 1 in a state of being arranged in the direction of conveyance of printing papers P. Each inkjet head 2 has a slender profile extending perpendicularly to FIG. 1.

The printer 1 includes therein a paper feed unit 114, a conveyance unit 120, and a paper receiving unit 116 provided in this order along the conveyance path for printing papers P. The printer 1 further includes therein a controller 100 that controls the operations of components and units of the printer 1 including the inkjet heads 2 and the paper feed unit 114.

The paper feed unit 114 includes a paper case 115 and a paper feed roller 145. The paper case 115 can contain therein a stack of printing papers P. The paper feed roller 145 can send out the uppermost one of the printing papers P contained in the paper case 115, one by one.

Between the paper feed unit 114 and the conveyance unit 120, two pairs of feed rollers 118*a* and 118*b*; and 119*a* and 119*b* are disposed along the conveyance path for printing papers P. Each printing paper P sent out of the paper feed unit 114 is guided by the feed rollers to be sent to the conveyance unit 120.

The conveyance unit 120 includes an endless conveyor belt 111 and two belt rollers 106 and 107. The conveyor belt 111 is wrapped on the belt rollers 106 and 107. The length of the conveyor belt 111 is adjusted so that a predetermined tension can be obtained when the conveyor belt 111 is stretched between the belt rollers. Thus, the conveyor belt 111 is stretched between the belt rollers without slacking, along two planes parallel to each other, each including a common tangent of the belt rollers. Of these two planes, the plane nearer to the inkjet heads 2 includes a conveyance surface 127 of the conveyor belt 111 on which printing papers P are conveyed.

As shown in FIG. 1, one belt roller 106 is connected to a conveyance motor 174. The conveyance motor 174 can rotate the belt roller 106 in the direction of an arrow A. The other belt roller 107 can follow the conveyor belt 111 to rotate. Thus, by driving the conveyance motor 174 to rotate the belt roller 106, the conveyor belt 111 is moved in the direction of the arrow A.

Near the belt roller 107, a nip roller 138 and a nip receiving roller 139 are disposed so as to nip the conveyor belt 111. The nip roller 138 is being biased downward by a not-shown spring. The nip receiving roller 139 disposed below the nip roller 138 is receiving through the conveyor belt 111 the force of the nip roller 138 being biased downward. Both of the nip roller 138 and the nip receiving roller 139 are freely rotatable and follow the conveyor belt 111 to rotate.

Each printing paper P sent from the paper feed unit 114 to the conveyance unit 120 is interposed between the nip roller 138 and the conveyor belt 111. Thereby, the printing paper P is pressed onto the conveyance surface 127 of the conveyor belt 111 to adhere to the conveyance surface 127. The printing paper P is then conveyed toward the inkjet heads 2 by the rotation of the conveyor belt 111. The outer circumferential surface 113 of the conveyor belt 111 may have been treated with adhesive silicone rubber. In this case, the printing paper P can surely adhere to the conveyance surface 127 of the conveyor belt 111.

Figure 3:
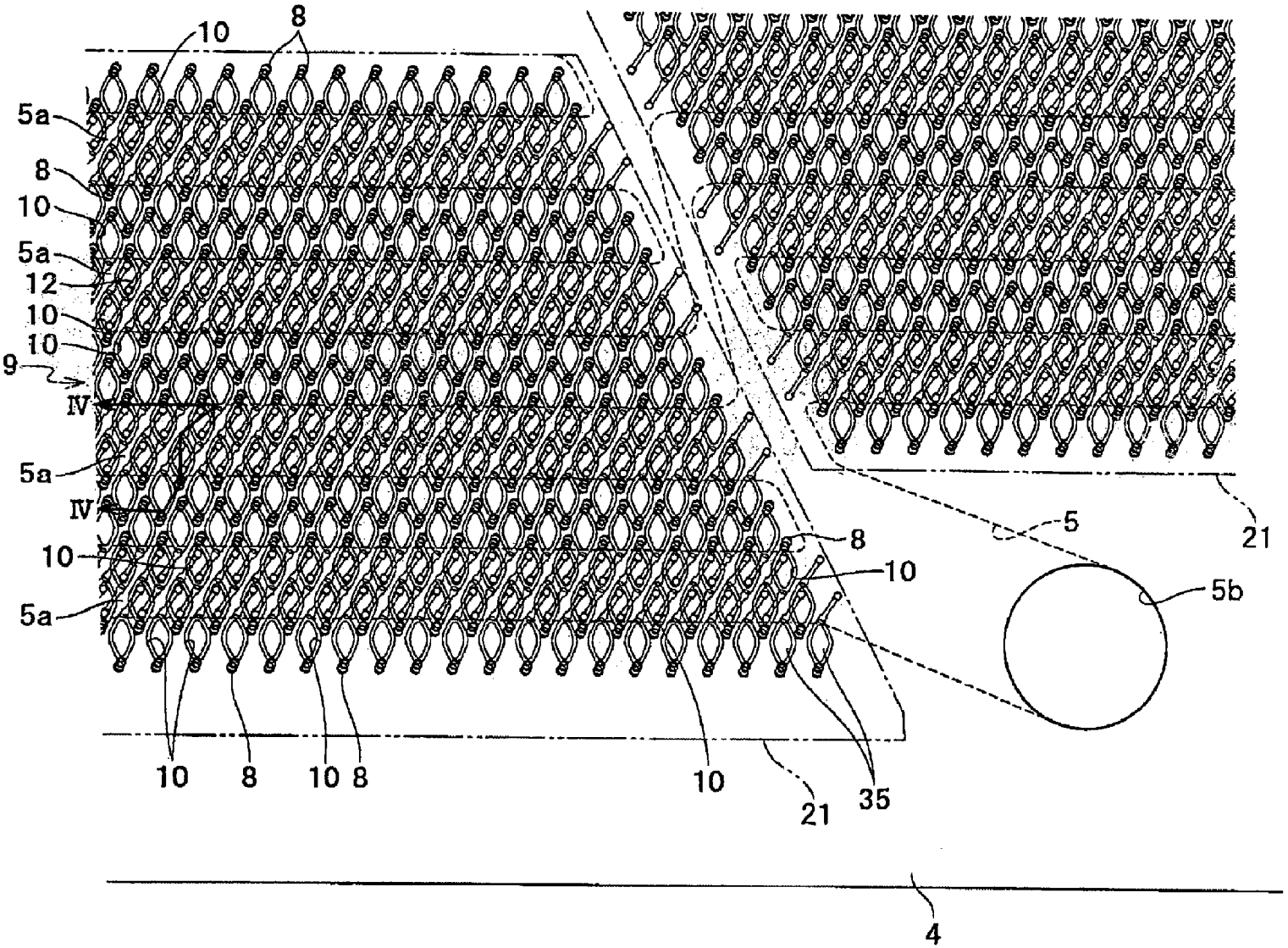
FIG. 3 is an enlarged view of a region enclosed with an alternate long and short dash line in FIG. 2.

Four inkjet heads 2 are arranged close to each other in the direction of conveyance by the conveyor belt 111. Each inkjet head 2 has at its lower end a head main body 13. A large number of nozzles 8 from each of which ink is ejected are formed on the lower face of each head main body 13, as shown in FIG. 3. Ink of the same color is ejected from the nozzles 8 formed on one inkjet head 2. Four inkjet heads 2 eject inks of colors of magenta (M), yellow (Y), cyan (C), and black (K), respectively. Each inkjet head 2 is disposed such that a narrow space is formed between its head main body 13 and the conveyance surface 127 of the conveyor belt 111.

Each printing paper P being conveyed by the conveyor belt 111 passes through the space between each inkjet head 2 and the conveyor belt 111. At this time, ink is ejected from the head main body 13 of the inkjet head 2 toward the upper surface of the printing paper P. Thus, a color image based on image data stored in the controller 100 is formed on the upper surface of the printing paper P.

Between the conveyance unit 120 and the paper receiving unit 116, there are provided a peeling plate 140 and two pairs of feed rollers 121*a* and 121*b*; and 122*a* and 122*b*. Each printing paper P on which a color image has been printed is conveyed by the conveyor belt 111 toward the peeling plate 140. The printing paper P is then peeled off the conveyance surface 127 of the conveyor belt 111 by a right edge of the peeling plate 140. The printing paper P is then sent to the paper receiving unit 116 by the feed rollers 121*a* to 122*b*. Printed printing papers P are thus sent to the paper receiving unit 116 in order, and then stacked on the paper receiving unit 116.

Figure 2:
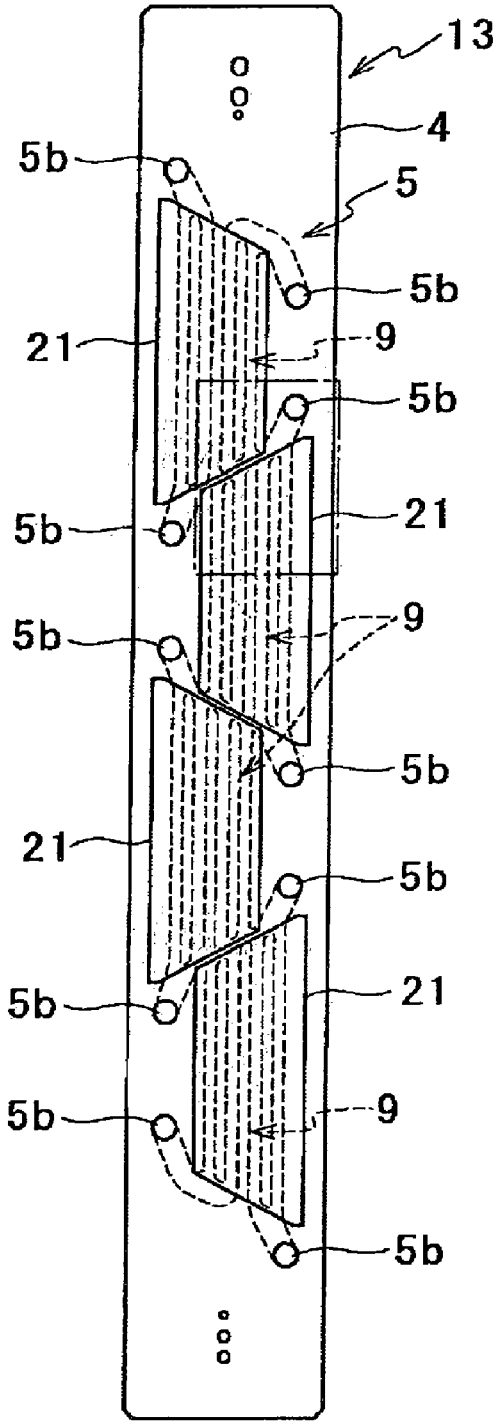
FIG. 2 is an upper view of a head main body shown in FIG. 1.

A paper sensor 133 is provided between the nip roller 138 and the inkjet head 2 disposed at the most upstream position in the conveyance direction of printing papers P. The paper sensor 133 is constituted by a light emitting element and a light receiving element so as to be able to detect the leading edge of each printing paper P on the conveyance path. The result of the detection by the paper sensor 133 is sent to the controller 100. On the basis of the detection result sent from the paper sensor 133, the controller 100 can control each inkjet head 2, the conveyance motor 174, and so on, such that the conveyance operation for each printing paper P and the printing operation for an image are synchronized with each other The head main body 13 of each inkjet head 2 will be described. FIG. 2 is an upper view of a head main body 13 shown in FIG. 1.

The head main body 13 includes a passage unit 4 and four actuator units 21 each bonded onto the passage unit 4. Each actuator unit 21 is substantially trapezoidal. Each actuator unit 21 is disposed on the upper surface of the passage unit 4 such that a pair of parallel opposed sides of the trapezoid of the actuator unit 21 extend longitudinally of the passage unit 4. Two actuator units 21 are arranged on each of two straight lines extending parallel to each other longitudinally of the passage unit 4. That is, four actuator units 21 are arranged zigzag on the passage unit 4 as a whole. Each neighboring oblique sides of actuator units 21 on the passage unit 4 partially overlap each other laterally of the passage unit 4.

Manifold channels 5 each of which is part of an ink passage are formed in the passage unit 4. An opening 5*b* of each manifold channel 5 is formed on the upper face of the passage unit 4. Five openings 5*b* are arranged on each of two straight lines, as imaginary lines, extending parallel to each other longitudinally of the passage unit 4. That is, ten openings 5*b* in total are formed. The openings 5*b* are formed so as to avoid the regions where four actuator units 21 are disposed. Ink is supplied from a not-shown ink tank into each manifold channel 5 through its opening 5*b*.

FIG. 3 is an enlarged upper view of a region enclosed with an alternate long and short dash line in FIG. 2. In FIG. 3, for convenience of explanation, each actuator unit 21 is shown by an alternate long and two short dashes line. In addition, apertures 12, nozzles 8, and so on, are shown by solid lines though they should be shown by broken lines because they are formed in the passage unit 4 or on the lower face of the passage unit 4.

Each manifold channel 5 formed in the passage unit 4 branches into a number of sub manifold channels 5*a*. The manifold channel 5 runs along an oblique side of an actuator unit 21 to cross a longitudinal axis of the passage unit 4. In a region between two actuator units 21, one manifold channel 5 is shared by the neighboring actuator units 21. Sub manifold channels 5*a* are branched from both sides of the manifold channel 5. Sub manifold channels 5*a* are formed in the passage unit 4 so as to neighbor each other in a region opposed to each actuator unit 21.

The passage unit 4 includes therein pressure chamber groups 9 each constituted by a large number of pressure chambers 10 arranged in a matrix. Each pressure chamber 10 is formed into a hollow region having a substantially rhombic shape in plan view each corner of which is rounded. Each pressure chamber 10 is open at the upper face of the passage unit 4. Pressure chambers 10 are arranged substantially over a region of the upper face of the passage unit 4 opposed to each actuator unit 21. Thus, each pressure chamber group 9 constituted by the pressure chambers 10 occupies a region having substantially the same size and shape as one actuator unit 21. The opening of each pressure chamber 10 is covered by the corresponding actuator unit 21 bonded onto the upper surface of the passage unit 4. In this embodiment, as shown in FIG. 3, sixteen rows of pressure chambers 10 arranged longitudinally of the passage unit 4 at regular intervals are arranged parallel to each other laterally of the passage unit 4. The pressure chambers 10 are provided such that the number of pressure chambers 10 belonging to each row gradually decreases from the long side toward the short side of the profile of the corresponding piezoelectric actuator 50. The nozzles 8 are provided likewise. This realizes image formation with a resolution of 600 dpi as a whole.

An individual electrode 35, as will be described later, is formed on the upper face of each actuator unit 21 so as to be opposed to each pressure chamber 10. The individual electrode 35 has its shape somewhat smaller than and substantially similar to the shape of the pressure chamber 10. The individual electrode 35 is disposed within a region of the upper face of the actuator unit 21 opposed to the pressure chamber 10.

Either of the pressure chamber 10 and the individual electrode 35 is long vertically in FIG. 3. Either of the pressure chamber 10 and the individual electrode 35 is tapered both upward and downward from its vertical center. This realizes dense arrangements of a large number of pressure chambers 10 and a large number of individual electrodes 35 in the respective planes.

A large number of nozzles 8 as ejection ports are formed on the passage unit 4. The nozzles 8 are disposed so as to avoid regions of the lower face of the passage unit 4 opposed to sub manifold channels 5*a*. The nozzles 8 are disposed within regions of the lower face of the passage unit 4 opposed to the respective actuator units 21. The nozzles B in each region are arranged at regular intervals on a number of straight lines each extending longitudinally of the passage unit 4.

The nozzles 8 are disposed such that projective points obtained by projecting the positions at which the respective nozzles 8 are formed, on an imaginary straight line extending longitudinally of the passage unit 4, perpendicularly to the straight line, are uninterruptedly arranged at regular intervals corresponding to the printing resolution. Thereby, the inkjet head 2 can perform printing uninterruptedly at intervals corresponding to the printing resolution, over substantially the whole area longitudinal of the regions of the passage unit 4 where the nozzles 8 are formed.

A large number of apertures 12 are formed in the passage unit 4. The apertures 12 are disposed in regions opposed to the respective pressure chamber groups 9. In this embodiment, the apertures 12 extend horizontally parallel to each other.

Figure 4:
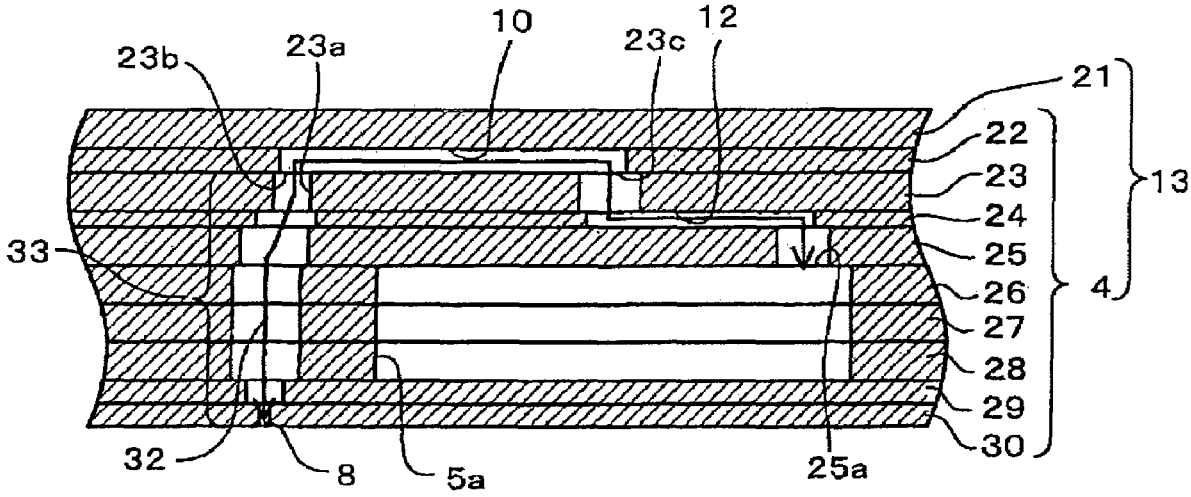
FIG. 4 is a vertically sectional view taken along line IV-IV in FIG. 3.

In the passage unit 4, connection holes are formed so as to connect each corresponding aperture 12, pressure chamber 10, and nozzle 8 with each other. The connection holes are connected with each other to form an individual ink passage 32, as shown in FIG. 4. Each individual ink passage 32 is connected with the corresponding sub manifold channel 5*a*. Ink supplied to each manifold channel 5 is supplied to each individual ink passage 32 via the corresponding sub manifold channel 5*a* and then ejected from the corresponding nozzle 8.

A sectional construction of the head main body 13 will be described. FIG. 4 is a vertically sectional view taken along line IV-IV in FIG. 3.

The passage unit 4 of the head main body 13 has a layered structure in which a number of plates are put in layers. That is, in the order from the upper face of the passage unit 4, there are disposed a cavity plate 22, a base plate 23, an aperture plate 24, a supply plate 25, manifold plates 26, 27, and 28, a cover plate 29, and a nozzle plate 30. A large number of connection holes are formed in each plate. The plates are put in layers after they are positioned so that connection holes formed through the respective plates are connected with each other to form each individual ink passage 32 and each sub manifold channel 5*a*. In the head main body 13, as shown in FIG. 4, the portions constituting each individual ink passage 32 are disposed close to each other at different positions, that is, a pressure chamber 10 is formed near the upper face of the passage unit 4, a sub manifold channel 5*a* is formed in the interior of a middle portion of the passage unit 4, and a nozzle 8 is formed on the lower face of the passage unit 4. Connection holes connect the sub manifold channel 5*a* with the nozzle 8 via the pressure chamber 10.

Connection holes formed through the respective plates will be described. The first is a pressure chamber 10 formed through the cavity plate 22. The second is a connection hole A provided as a second partial passage leading from one end of the pressure chamber 10 to a sub manifold channel 5*a*. The connection hole A is formed through the plates from the base plate 23 as the inlet of the pressure chamber 10 to the supply plate 25 as the outlet of the sub manifold channel 5*a*. The connection hole A includes an aperture 12 formed through the aperture plate 24.

The third is a connection hole B provided as a first partial passage leading from the other end of the pressure chamber 10 to a nozzle 8. The connection hole B is formed through the plates from the base plate 23 as the outlet of the pressure chamber 10 to the cover plate 29. In the below, the connection hole B will be referred to as descender 33. The fourth is the nozzle 8 formed through the nozzle plate 30. The nozzle 8 cooperates with the connection hole B to form the descender 33 as the first partial passage. The fifth is a connection hole C to form the sub manifold channel 5*a*. The connection hole C is formed through the manifold plates 26 to 28.

The above connection holes are connected with each other to form an individual ink passage 32 leading from an ink inlet port from the sub manifold channel 5*a*, that is, the outlet of the sub manifold channel 5*a*, to the nozzle 8. Ink supplied to the sub manifold channel 5*a* flows to the nozzle 8 in the following passage. First, ink flows upward from the sub manifold channel 5*a* to one end of the aperture 12. Next, ink horizontally flows longitudinally of the aperture 12 to the other end of the aperture 12. Ink then flows upward from the other end of the aperture 12 to one end of the pressure chamber 10. Ink then horizontally flows longitudinally of the pressure chamber 10 to the other end of the pressure chamber 10. Ink then flows obliquely downward and through three plates to the nozzle 8 just below the connection hole C.

A connection hole 23*a* including the boundary 23*b* between the descender 33 and the pressure chamber 10, and the nozzle 8, are narrower than the other portion of the descender 33. That is, in a section perpendicular to a longitudinal axis of the descender 33, that is, the corresponding portion of a two-headed arrow showing the individual ink passage in FIG. 4, the sectional areas of the connection hole 23*a* and the nozzle 8 are smaller than the sectional area of the other portion of the descender 33. This is a structure in which proper oscillation whose both ends are near the nozzle 8 and the connection hole 23*a* is relatively apt to be generated in ink filling up the descender 33.

The area of a section of the aperture 12 perpendicular to a longitudinal axis of the aperture 12, that is, the corresponding portion of the two-headed arrow showing the individual ink passage in FIG. 4, is smaller than either of the area of the connection hole A at the boundary 23*c* with the pressure chamber 10, and the area of the outlet 25*a* of the sub manifold channel 5*a*. Thus, the aperture 12 functions as a restricted passage, and this realizes a structure suitable for ink ejection by a fill-before-fire method.

Figure 5:
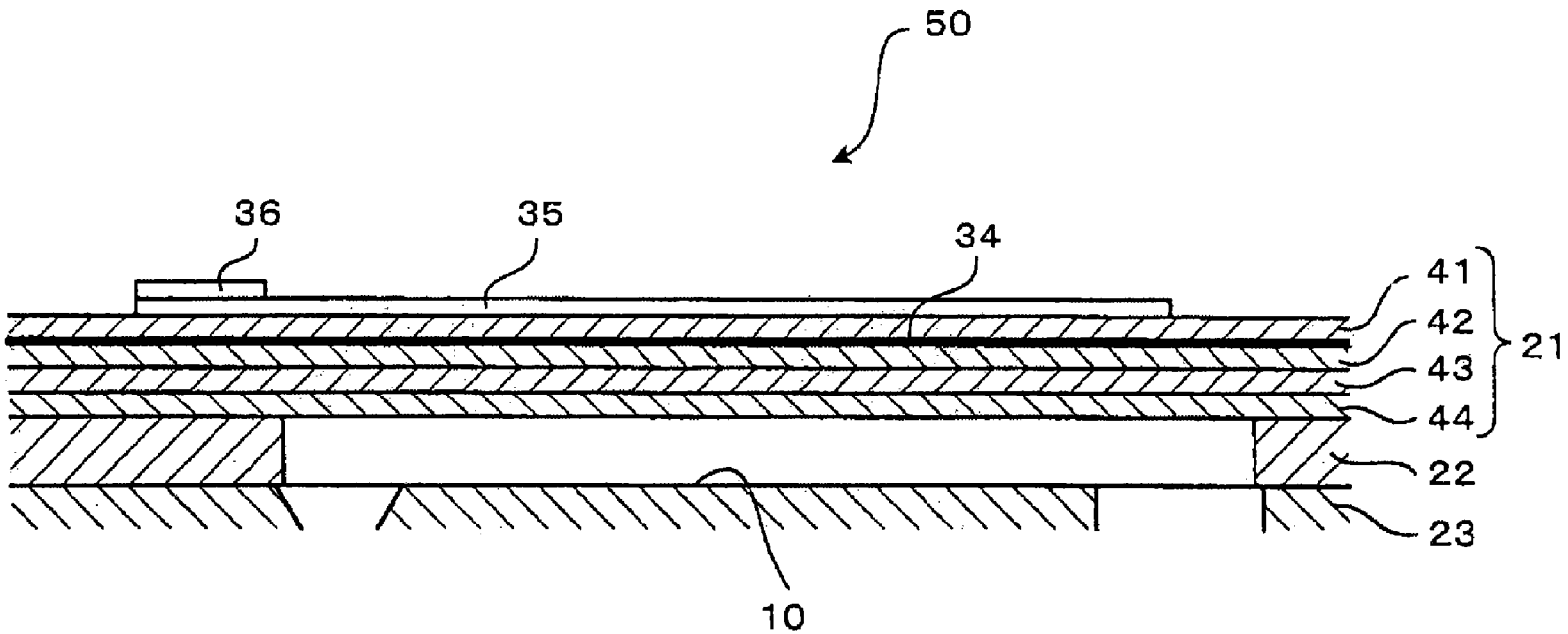
FIG. 5 is a partial enlarged view near a piezoelectric actuator shown in FIG. 4.

As shown in FIG. 5, each actuator unit 21 has a layered structure in which four piezoelectric layers 41, 42, 43, and 44 are put in layers. Each of the piezoelectric layers 41 to 44 has a thickness of about 15 micrometers. The whole thickness of the actuator unit 21 is about 60 micrometers. Any of the piezoelectric layers 41 to 44 is disposed over a large number of pressure chambers 10, as shown in FIG. 3. Each of the piezoelectric layers 41 to 44 is made of a lead zirconate titanate (PZT)-base ceramic material having ferroelectricity.

The actuator unit 21 includes individual electrodes 35 and a common electrode 34, each of which is made of, for example, an Ag—Pd-base metallic material. As described before, each individual electrode 35 is disposed on the upper face of the actuator unit 21 so as to be opposed to the corresponding pressure chamber 10. One end of the individual electrode 35 is extended out of the region opposed to the pressure chamber 10, and a land 36 is formed on the extension. The land 36 is made of, for example, gold containing glass frit. The land 36 has a thickness of about 15 micrometers and is convexly formed. The land 36 is electrically connected to a contact provided on a not-shown flexible printed circuit (FPC). As will be described later, the controller 100 supplies a voltage pulse to each individual electrode 35 via the FPC.

The common electrode 34 is interposed between the piezoelectric layers 41 and 42 so as to spread over substantially the whole area of the interface between the layers. That is, the common electrode 34 spreads over all pressure chambers 10 in the region opposed to the actuator unit 21. The common electrode 34 has a thickness of about 2 micrometers. The common electrode 34 is grounded in a not-shown region to be kept at the ground potential. In this embodiment, a not-shown surface electrode different from the individual electrodes 35 is formed on the piezoelectric layer 41 so as to avoid the group of the individual electrodes 35. The surface electrode is electrically connected to the common electrode 34 through a through hole formed in the piezoelectric layer 41. Like a large number of individual electrodes 35, the surface electrode is connected to another contact and wiring on the FPC 50.

As shown in FIG. 5, each individual electrode 35 and the common electrode 34 are disposed so as to sandwich only the uppermost piezoelectric layer 41. The region of the piezoelectric layer sandwiched by the individual electrode 35 and the common electrode 34 is called an active portion. In each actuator unit 21 of this embodiment, only the uppermost piezoelectric layer 41 includes therein such active portions and the remaining piezoelectric layers 42 to 44 includes therein no active portions. That is, the actuator unit 21 has a so-called unimorph structure.

As will be described later, when a predetermined voltage pulse is selectively supplied to each individual electrode 35, a pressure is applied to ink in the pressure chamber 10 corresponding to the individual electrode 35. Thereby, ink is ejected from the corresponding nozzle 8 through the corresponding individual ink passage 32. That is, a portion of the actuator unit 21 opposed to each pressure chamber 10 serves as an individual piezoelectric actuator 50 corresponding to the pressure chamber 10 and the corresponding nozzle 8. In the layered structure constituted by four piezoelectric layers, such an actuator as a unit structure as shown in FIG. 5 is formed for each pressure chamber 10. Each actuator unit 21 is thus constructed. In this embodiment, the amount of ink to be ejected from a nozzle 8 by one ejection operation is about 5 to 7 pl (picoliters).

Next, control of the actuator units 21 will be described. For controlling the actuator units 21, the printer 1 includes therein a controller 100 and driver ICs 80. The printer 1 includes therein a central processing unit (CPU) as an arithmetic processing unit; a read only memory (ROM) storing therein computer programs to be executed by the CPU and data used in the programs; and a random access memory (RAM) for temporarily storing data in execution of a computer program. These components constitute the controller 100 having functions as will be described below.

Figure 6:
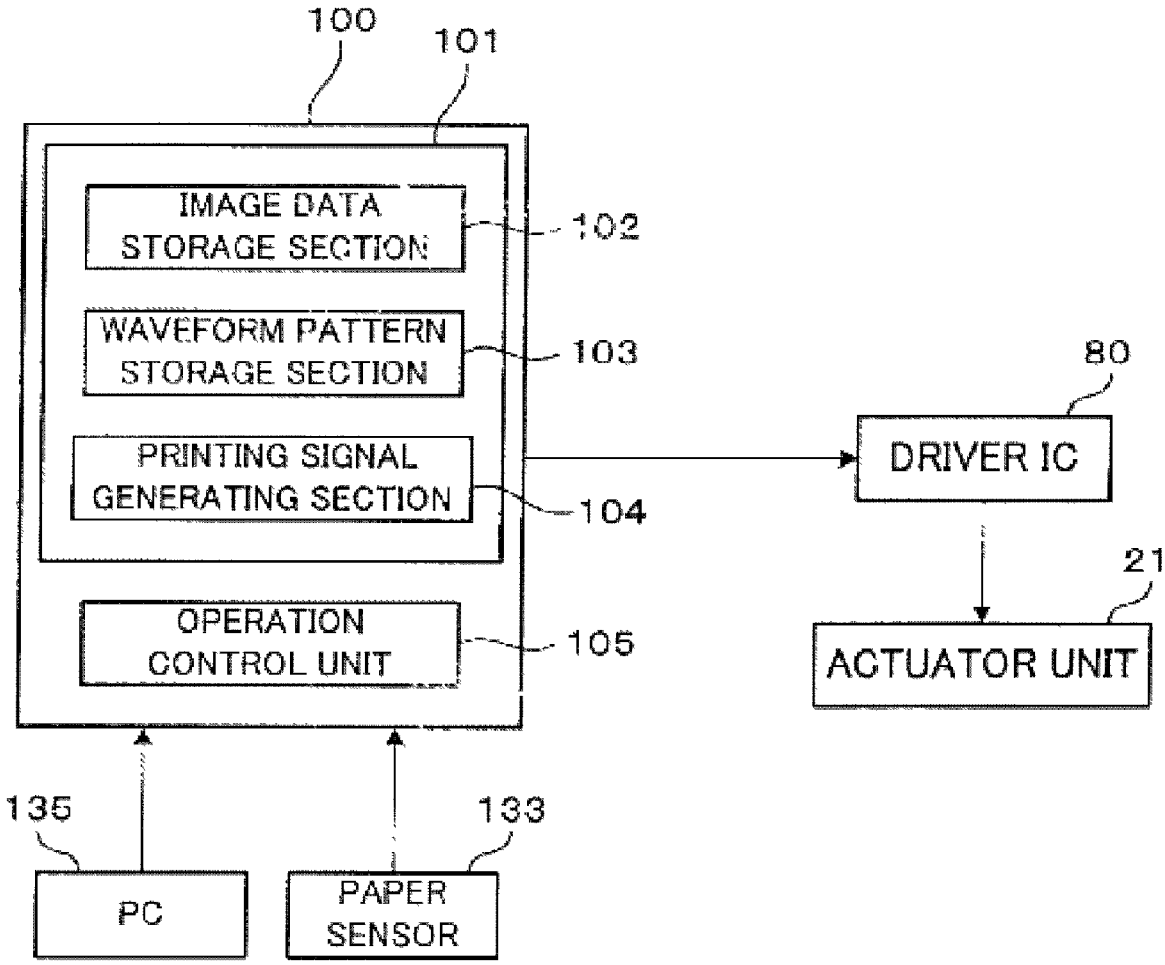
FIG. 6 is a block diagram showing a construction of a controller included in the printer shown in FIG. 1.

As shown in FIG. 6, the controller 100 includes therein a printing control unit 101 and an operation control unit 105. The printing control unit 101 includes therein an image data storage section 102, a waveform pattern storage section 103, and a printing signal generating section 104. The image data storage section 102 stores therein image data for printing, transmitted from, for example, a personal computer (PC) 135.

The waveform pattern storage section 103 stores therein waveform data corresponding to a number of ejection pulse train waveforms. Each ejection pulse train waveform corresponds to a basic waveform in accordance with the tone and so on of an image. A voltage pulse signal corresponding to the waveform is supplied to individual electrodes 35 via the corresponding driver IC 80 and thereby an amount of ink corresponding to each tone is ejected from each inkjet head 2.

The printing signal generating section 104 generates serial printing data on the basis of image data stored in the image data storage section 102. The printing data corresponds to one of data items corresponding to the respective ejection pulse train waveforms stored in the waveform pattern storage section 103. The printing data is for instruction for supplying an ejection pulse train waveform to each individual electrode 35 at a predetermined timing. On the basis of image data stored in the image data storage section 102, the printing signal generating section 104 generates printing data in accordance with timings, a waveform, and individual electrodes, corresponding to the image data. The printing signal generating section 104 then outputs the generated printing data to each driver IC 80.

A driver IC 80 is provided for each actuator unit 21. The driver IC 80 includes a shift register, a multiplexer, and a drive buffer, though any of them is not shown.

The shift register converts the serial printing data output from the printing signal generating section 104, into parallel data. That is, following the instruction of the printing data, the shift register outputs an individual data item to the piezoelectric actuator 50 corresponding to each pressure chamber 10 and the corresponding nozzle 8.

On the basis of each data item output from the shift register, the multiplexer selects appropriate one out of the waveform data items stored in the waveform pattern storage section 103. The multiplexer then outputs the selected data item to the driver buffer.

On the basis of the waveform data item output from the multiplexer, the drive buffer generates an ejection voltage pulse train signal having a predetermined level. The drive buffer then supplies the ejection voltage pulse train signal to the individual electrode 35 corresponding to each piezoelectric actuator 50, through the FPC.

Next will be described an ejection voltage pulse train signal and a change in the potential of an individual electrode 35 having received the signal.

Figure 7:
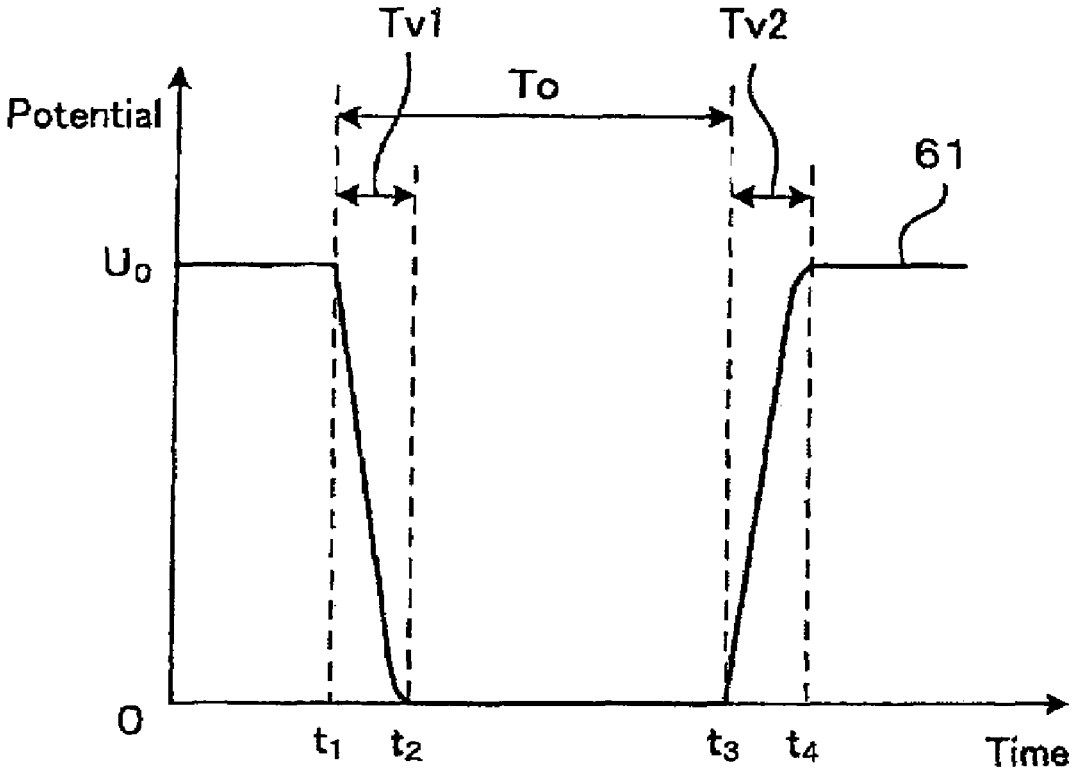
FIG. 7 is a graph showing an example of a change in the potential of an individual electrode to which a voltage pulse signal is supplied.

The voltage at each time contained in the ejection voltage pulse train signal will be described. FIG. 7 shows an example of a change in the potential of an individual electrode 35 to which the ejection voltage pulse train signal is supplied. The waveform 61 of the ejection voltage pulse train signal shown in FIG. 7 is an example of a waveform for ejecting one droplet of ink from a nozzle 8.

At a time t1, the ejection voltage pulse train signal starts to be supplied to the individual electrode 35. The time t1 is controlled in accordance with a timing at which ink is ejected from the nozzle 8 corresponding to the individual electrode 35. In the waveform 61 of the ejection voltage pulse train signal, the voltage is kept at U0 which is not equal to zero, in the period to the time t1 and in the period after a time t4. In the period from a time t2 to a time t3, the voltage is kept at the ground potential. The period Tv1 from the time t1 to the time t2 is a transient period in which the potential of the individual electrode 35 changes from U0 to the ground potential. The period Tv2 from the time t3 to the time t4 is a transient period in which the potential of the individual electrode 35 changes from the ground potential to U0 The periods Tv1 and Tv2 have been set to the same length. As shown in FIG. 5, each piezoelectric actuator 50 has the same construction as a capacitor. Thus, when the potential of the individual electrode 35 changes, the above transient periods appear in accordance with accumulation and emission of electric charges.

The length To of the period from the time t1 to the time t3 has been determined by a control condition determining step, which will be described later. The waveform pattern storage section 103 stores therein the waveform 61 based on To thus determined in advance. More specifically, the waveform pattern storage section 103 stores therein the waveform 61 controlled such that the value of To/Tc falls within a range from 0.51 to 0.54, where Tc represents the proper oscillation period of ink filling up the whole of an individual ink passage 32.

Next will be described how the piezoelectric actuator 50 is driven when the above ejection voltage pulse train signal is supplied to the individual electrode 35.

In each actuator unit 21 of this embodiment, only the uppermost piezoelectric layer 41 has been polarized in the direction from each individual electrode 35 toward the common electrode 34. Thus, when an individual electrode 35 is set at a different potential from the common electrode 34 so as to apply an electric field to the piezoelectric layer 41 in the same direction as that of the polarization, more specifically, in the direction from the individual electrode 35 toward the common electrode. 34, the portion to which the electric field has been applied, that is, the active portion, attempts to elongate in the thickness, that is, perpendicularly to the layer. At this time, the active portion attempts to contract parallel to the layer, that is, in the plane of the layer. On the other hand, the remaining three piezoelectric layers 42 to 44 have not been polarized, and they are not deformed by themselves even when an electric field is applied to them.

A difference in distortion is thus generated between the piezoelectric layer 41 and the piezoelectric layers 42 to 44. Therefore, each piezoelectric actuator 50 is deformed as a whole to be convex toward the corresponding pressure chamber 10, that is, to the piezoelectric layers 42 to 44 side, which is called unimorph deformation.

Figure 8A:
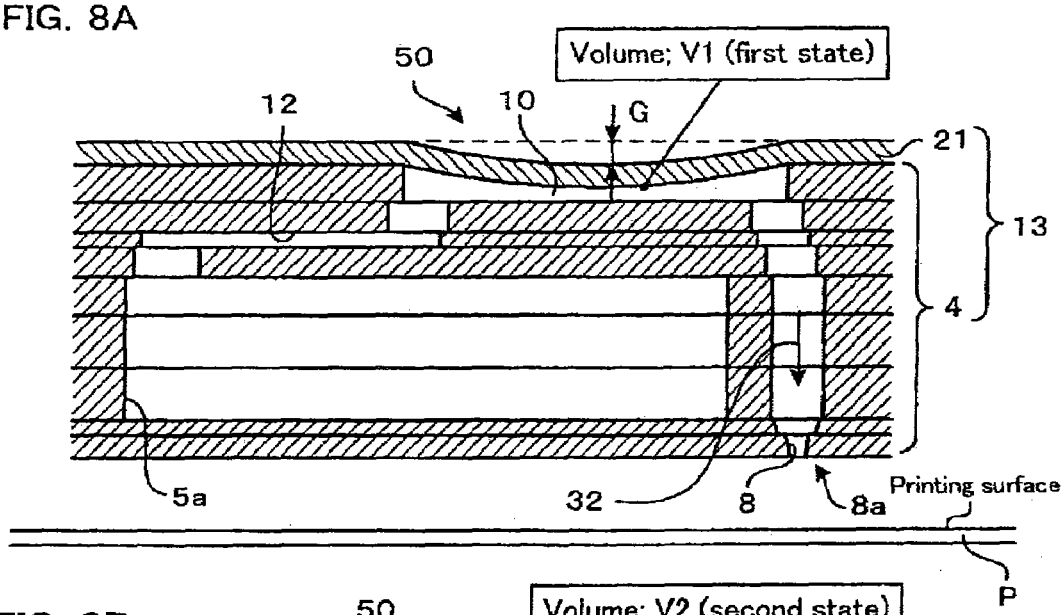
FIGS. 8A, 8B, and 8C show a driving manner of a piezoelectric actuator when the potential of an individual electrode changes as shown in FIG. 7 by supplying a voltage pulse signal.
Figure 8B:
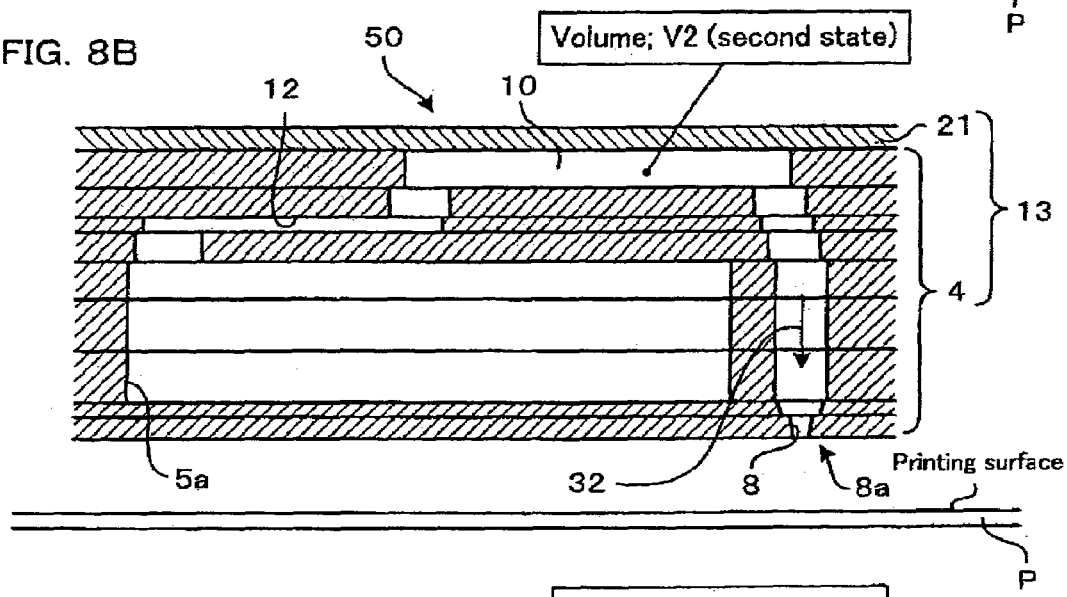
Figure 8C:
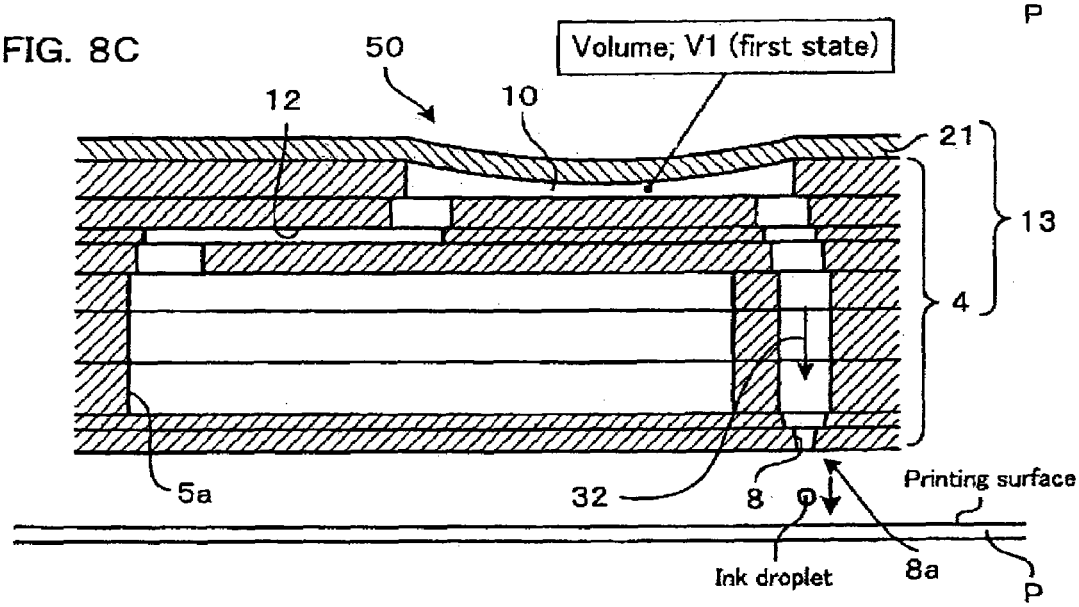

Next will be described drive of a piezoelectric actuator 50 when a voltage pulse signal corresponding to the waveform 61 is supplied to the corresponding individual electrode 35. FIGS. 8A to 8C show a change in the piezoelectric actuator 50 with time.

FIG. 8A shows the state of the piezoelectric actuator 50 in the period to the time t1 shown in FIG. 7. At this time, the potential of the individual electrode 35 is U0 The piezoelectric actuator 50 protrudes into the corresponding pressure chamber 10 by the above-described unimorph deformation. The volume of the pressure chamber 10 at this time is V1. This state of the pressure chamber 10 will be referred to as a first state.

FIG. 8B shows the state of the piezoelectric actuator 50 in the period from the time t2 to the time t3 shown in FIG, 7 At this time, the individual electrode 35 is at the ground potential. Therefore, the electric field disappears that was applied to the active portion of the piezoelectric layer 41, and the piezoelectric actuator 50 is released from its unimorph deformation The volume V2 of the pressure chamber 10 at this time is larger than the volume V1 of the pressure chamber 10 shown in FIG. 8A. This state of the pressure chamber 10 will be referred to as a second state. As a result of an increase in the volume of the pressure chamber 10, ink is sucked into the pressure chamber 10 from the corresponding sub manifold channel 5*a*.

FIG. 8C shows the state of the piezoelectric actuator 50 in the period after the time t4 shown in FIG. 7. At this time, the potential of the individual electrode 35 is U0 Therefore, the piezoelectric actuator 50 has been again restored to the first state. By the piezoelectric actuator 50 thus changing the pressure chamber 10 from the second state into the first state, a pressure is applied to ink in the pressure chamber 10. Thereby, an ink droplet is ejected from the corresponding nozzle 8. The ink droplet impacts the printing surface of a printing paper P to form a dot. As described above, in the drive of the piezoelectric actuator 50 of this embodiment, first, the volume of the pressure chamber 10 is once increased to generate a negative pressure wave in ink in the pressure chamber 10, as shown from FIG. 8A to FIG. 8B. The pressure wave is reflected by an end of the ink passage in the passage unit 4, and thereby returned as a positive pressure wave progressing toward the nozzle 8. With estimating a timing at which the positive pressure wave reaches the interior of the pressure chamber 10, the volume of the pressure chamber 10 is again decreased, as shown from FIG. 8B to FIG. 8C. This is a so-called fill-before-fire method.

In order to realize ink ejection by the above-described fill-before-fire method, the pulse width To of the voltage pulse having the waveform 61 for ink ejection, as shown in FIG. 7, is adjusted to the acoustic length (AL). In this embodiment, each pressure chamber 10 is provided near the center of the whole length of the corresponding individual ink passage 32, and AL is the length of a time period for which a pressure wave generated in the pressure chamber 10 progresses from the corresponding aperture 12 to the corresponding nozzle 8. In this construction, the positive pressure wave reflected as described above is superimposed on a positive pressure wave generated because of deformation of the corresponding piezoelectric actuator 50 so that a higher pressure is applied to ink. Therefore, in comparison with a case wherein the volume of the pressure chamber 10 is decreased only one time to push ink out, the driving voltage for the piezoelectric actuator 50 is held down when the same amount of ink is ejected. Thus, the fill-before-fire method is advantageous in high integration of pressure chambers 10, compactification of an inkjet head 2, and the running cost for driving the inkjet head 2.

Figure 12:
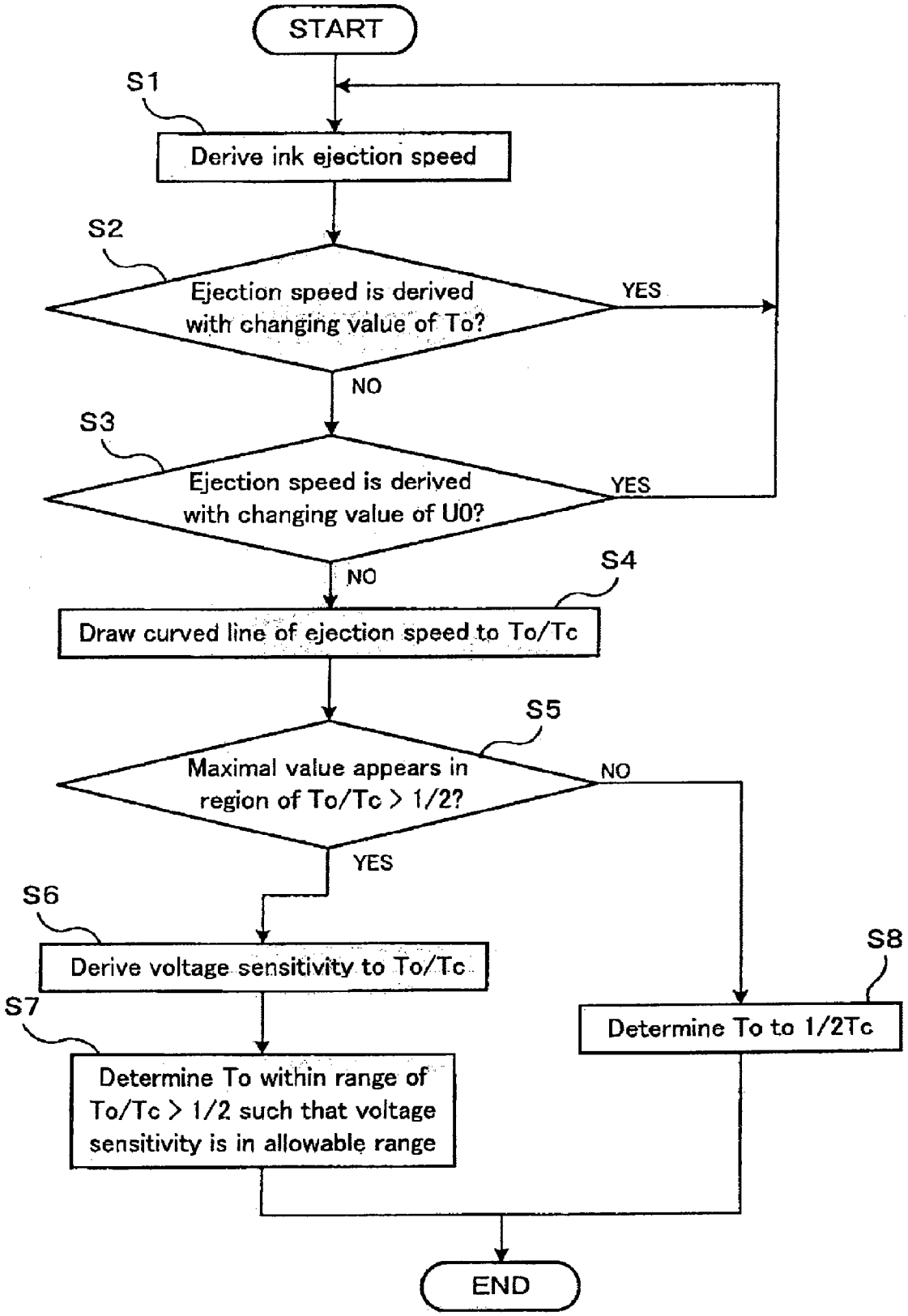
FIG. 12 is a flowchart showing a series of steps for determining a condition for controlling an inkjet head of the embodiment, on the basis of the analysis by the inventors of the present invention.

Next will be described a series of steps for determining a control condition on the waveform of the voltage pulse signal to be supplied to an individual electrode 35 in this embodiment. FIG. 12 is a flowchart showing, by way of example, steps for determining the control condition. The steps for determining the control condition are applied to a case wherein the relation of the ink ejection speed to To is as shown by a curved line 70 in FIG. 9 when ink is ejected from an inkjet head 2. That is, the steps are applied to a case wherein the curve of the ejection speed has a general shape being convex in the direction of the ejection speed increasing.

First, in Step S1, U0 and To are set to respective arbitrary values and then an ink ejection speed from a nozzle 8 when the voltage pulse signal of the waveform 61 of FIG. 7 is supplied to the corresponding individual electrode 35, is derived. The ink ejection speed is derived by using numeric analysis as described before. The ink ejection speed is repeatedly derived with variously changing the value of To without changing the value of U0, which is Yes in Step S2.

After the derivations of the ink ejection speeds with variously changing the value of To are completed, that is, No in Step S2, Steps S1 and S2 are repeated with variously changing the value of U0, which is Yes in Step S3. Ink ejection speeds to various values of To and U0 are thus derived. In a modification, ink ejection speeds to To may be derived not by numeric analysis but by actually measuring ink ejection speeds when various voltage pulse signals different in To and U0 are supplied.

After the derivations of the ink ejection speeds with variously changing the values of To and U0 are completed, that is, No in Step S3, the flow advances to Step S4, in which a curve of the ink ejection speed to To/Tc is drawn. In Step S5, it is judged whether or not a maximal value appears on the curve of the ejection speed in a region of To/Tc>½. In a modification, a function of the ejection speed to To/Tc may be derived so that it is judged by a derivative of the function whether or not a maximal value appears in the above region.

When it is decided that a maximal value appears in the region of To/Tc>½, that is, Yes in Step S5, the flow advances to Step S6, in which the voltage sensitivity to each value of To/Tc is obtained. The voltage sensitivity indicates the gradient of a regression line when the ejection speeds to the respective values of U0 are plotted on an xy-coordinate system as described above. In Step S7, a value of To is determined on the basis of Table 4 such that the resultant voltage sensitivity does not bring about the reproducibility of an image to be printed, beyond the bounds of practical permissibility. If To/Tc>½ and the ejection speed takes no maximal value, the value of To may be determined by using another reference than Table 4.

When it is decided in Step S5 that no maximal value appears in the region of To/Tc>½, that is, No in Step S5, the flow advances to Step S8, in which the value of To is determined to ½Tc.

By determining the value of To as described above, when a maximal value appears on the curve of the ejection speed in the region of To/Tc>½, the value of To is set such that the voltage sensitivity is not beyond the bounds of practical permissibility. Each inkjet head 2 of this embodiment has been adjusted such that To/Tc is within a range from 0.51 to 0.54. Thereby, as will be understood from the analysis that will be described later, variation in ink ejection speed is prevented from becoming too wide relatively to variation in the degree of deformation of the corresponding piezoelectric actuator 50, as shown by G in FIG. 8A. This prevents the reproducibility of an image to be printed from being beyond the bounds of permissibility. On the other hand, when no maximal value appears on the curve of the ejection speed in the region of To/Tc>½, the value of To is determined to ½Tc. In this case, control is performed so as to improve the efficiency of energy in ink ejection.

Next will be described analysis performed by the inventors of the present invention.

Figure 9:
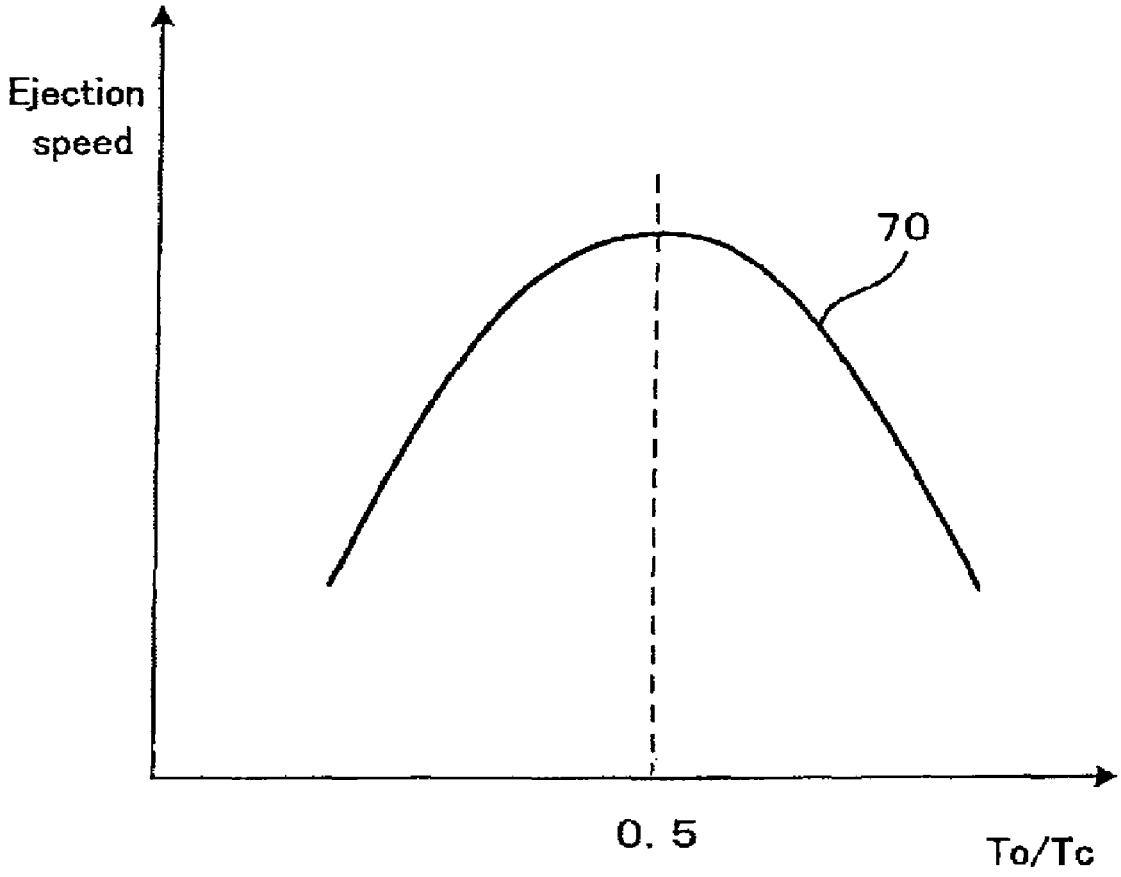
FIG. 9 is a graph showing a relation of the ejection speed of ink droplets ejected from a nozzle when a voltage pulse corresponding to FIG. 7 is supplied to an individual electrode, to To/Tc, where To represents the pulse width.

The inventors of the present invention confirmed that a conventional inkjet head has the following problem. FIG. 9 is a graph showing a general ejection characteristic when ink is ejected by a fill-before-fire method from an inkjet head having a construction as that of an inkjet head 2. In FIG. 9, the axis of abscissas represents the value of To/Tc, and the axis of ordinate represents the ink ejection speed. Tc represents the proper oscillation period of ink filling up the whole of an individual ink passage 32 leading from a sub manifold channel 5*a* through a pressure chamber 10 to a nozzle 8, as shown in FIG. 4. As shown by the curved line 70 in FIG. 9, the ink ejection speed takes a maximal value when To/Tc=½. Therefore, when a voltage pulse signal of the waveform 61 that satisfies the condition of To=AL=½Tc, is supplied to the corresponding individual electrode 35, ink is ejected most efficiently in ink ejection speed.

However, it is thinkable that applying a pressure by the piezoelectric actuator 50 may cause not only a progressive wave in ink in the individual ink passage 32 but also local proper oscillation in ink in a region of the individual ink passage 32. The inventors of the present invention thought that the local proper oscillation causes an increase in variation in ink ejection speed relative to variation in the degree of actuator deformation, as described above. That is, because a peak of a pressure wave generated due to the local proper oscillation overlaps a peak of the above progressive wave in the nozzle 8, the ejection speed of ink increases in comparison with a case of no local proper oscillation. As a result, a tip portion of an ink droplet is split off from the main body of the ink droplet to generate a high-speed small ink droplet.

More details of the above phenomenon are as follows. In ink ejection, when a pressure wave is generated in ink filling up a pressure chamber 10 due to deformation of the corresponding piezoelectric actuator 50, the pressure wave progresses both upstream and downstream in the pressure chamber 10. In a fill-before-fire method, the volume of the pressure chamber 10 is once increased and then the pressure chamber 10 is again restored to its original volume after a time corresponding to the pulse width To elapses, to eject ink from the corresponding nozzle. First, when the volume of the pressure chamber 10 is increased, a negative pressure wave is generated in ink in the pressure chamber 10, which wave will be referred to as a first pressure wave. Successively, when the volume of the pressure chamber 10 is decreased, a positive pressure wave is generated, which will be referred to as a second pressure wave.

Parts of the pressure waves progress downstream into the descender 33, as described above. For example, the first pressure wave having progressed into the descender 33 is reflected by both ends of the descender 33, that is, by the boundary between the pressure chamber 10 and the descender 33 and a portion near the nozzle 8. The reflected waves induce proper oscillation in ink filling up the descender 33. This proper oscillation generated in the descender 33 is an example of the above-described local proper oscillation.

On the other hand, part of the first pressure wave progresses upstream in the pressure chamber 10 toward the corresponding sub manifold channel 5*a*. The first pressure wave is reflected by the aperture 12 in the middle of the passage to become a pressure wave in which the sign of the pressure has inverted. The pressure wave having inverted in the sigh of the pressure progresses through the pressure chamber 10 and the descender 33 toward the nozzle 8. That is, the first pressure wave inverts in the sign of the pressure when reflected by the aperture 12, and the reflected pressure wave returns to the pressure chamber 10 as a positive pressure wave, which will be referred to as a third pressure wave. The piezoelectric actuator 50 then generates the second pressure wave in ink in the pressure chamber 10. When a composite wave in which the second pressure wave has been superimposed on the third pressure wave to form a progressive wave, reaches the nozzle 8, ink is ejected from the nozzle 8.

Further, parts of the second and third pressure waves are superimposed on the proper oscillation generated in the descender 33 due to the first pressure wave. That is, any of the first to third pressure waves contributes the proper oscillation in the descender 33. Thus, when the progressive wave composed of the second and third pressure waves reaches the nozzle 8, the oscillation in which all of (1) the contribution by the progressive wave itself; (2) the contribution by the first pressure wave to the proper oscillation in the descender 33; and (3) the contribution by parts of the second and third pressure waves to the proper oscillation in the descender 33, have been superimposed on each other, is observed in the nozzle 8.

The oscillation in which the above-described contributions have been superimposed on each other in the nozzle 8, causes an increase in the pressure to be applied to ink near the nozzle 8. In this case, when there is variation in the degree of deformation of the piezoelectric actuator 50, the variation influences all of the above contributions (1) to (3). Thus, it is thinkable that the pressure to be applied to ink near the nozzle 8 also receives the influences in a superimposed form. It is thinkable that variation in ink ejection speed thereby increases relatively to variation in the degree of actuator deformation.

Figure 10A:
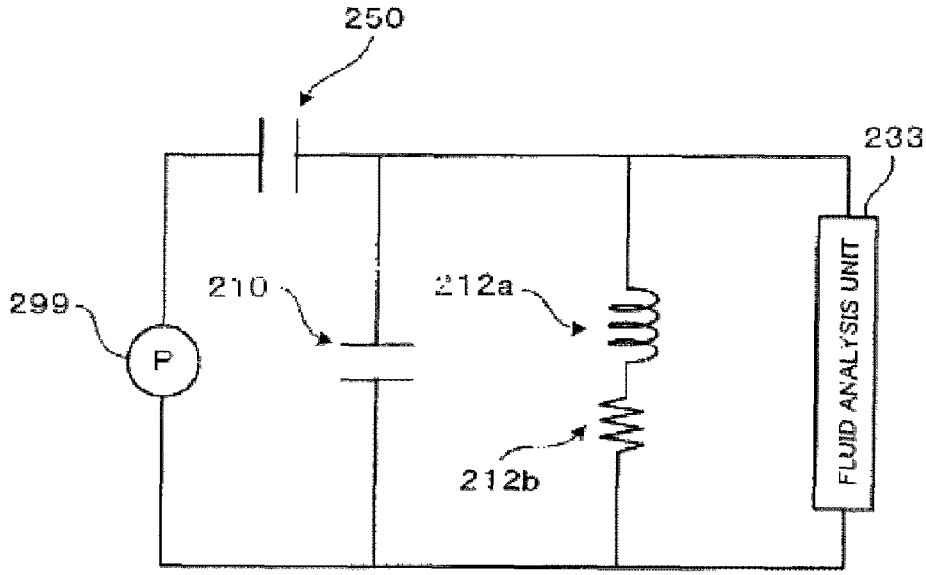
FIG. 10A shows an equivalent circuit obtained by modeling an individual ink passage shown in FIG. 4, used in analysis by the inventors of the present invention.
Figure 10B:
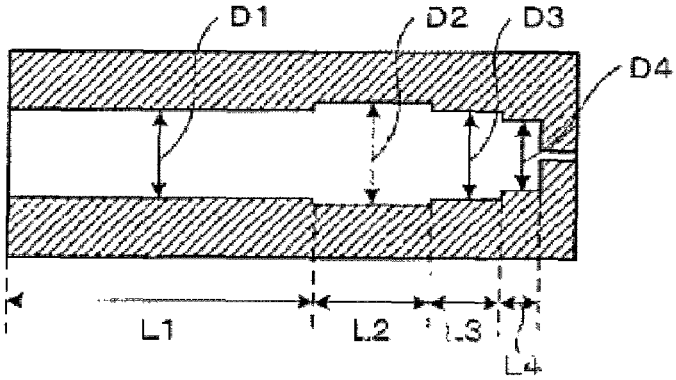
FIG. 10B shows a structure of a first partial passage in a fluid analysis unit shown in FIG. 10A.
Figure 10C:
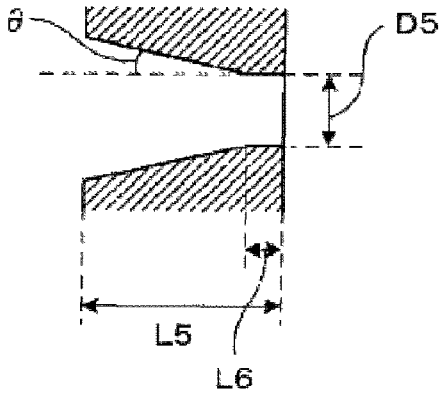
FIG. 10C shows a structure of a nozzle in the first partial passage shown in FIG. 10B.

For confirming the above, the inventors of the present invention carried out the following numeric analysis. FIGS. 10A to 10C show a model corresponding to an individual ink passage 32 used in the numeric analysis.

In the numeric analysis, a circuit is constructed by acoustically equivalent conversion of an individual ink passage 32 as shown in FIG. 4, that is, a passage leading from the ink inlet port from a sub manifold channel 5*a* to a nozzle 8. The equivalent circuit was acoustically analyzed. FIG. 10A shows the equivalent circuit.

The equivalent circuit as will be described below corresponds to an ink passage and an actuator as shown in, for example, FIGS. 4, and 5. In the below description, therefore, the terms of the descender 33, the piezoelectric actuator 50, and so on, as shown in, for example, FIGS. 4 and 5, will be used. However, information on, for example, the actuator shown in FIG. 5, necessary for the numeric analysis, is compliance. Therefore, in any actuator having the same compliance to apply a pressure to ink in a pressure chamber, the same results of the numeric analysis are obtained. That is, the results obtained by the numeric analysis as will be described below can apply to not only the passage unit 4 and the piezoelectric actuator 4 shown in, for example, FIGS. 4 and 5, but also any inkjet head that satisfies the conditions used in the numeric analysis.

The aperture 12 constituting the individual ink passage 32 corresponds to a coil 212*a* and a resistor 212*b* in the circuit of FIG. 10A. The piezoelectric actuator 50 and the pressure chamber 10 correspond to a capacitor 250 and a capacitor 210 in the circuit of FIG. 10A, respectively. The descender 33 and the nozzle 8 correspond to a fluid analysis unit 233 in the circuit of FIG. 10A. The fluid analysis unit 233 is not considered a mere capacitor, resistor, or the like, in the circuit. The fluid analysis unit 233 is numerically analyzed separately by fluid analysis as will be described later.

In acoustic analysis in the numerical analysis, there are used the thickness of the piezoelectric actuator 50; the area and the depth, which is perpendicularly to the piezoelectric layers, of the pressure chamber 10; the width, the length, and the depth, which is perpendicularly to the piezoelectric layers, of the aperture 12; and so on. The compliance of the piezoelectric actuator 50, which is an acoustic capacitance corresponding to the capacitance of the capacitor 250 in the equivalent circuit, and the constant of pressure to be generated by the piezoelectric actuator 50, have been obtained in advance by a finite element technique from the above data of the piezoelectric actuator 50 and so on. The piezoelectric constant has been obtained by using a resonance method in which the impedance of a piezoelectric element is measured.

As described above, the fluid analysis unit 233 corresponds to the descender 33. FIG. 10B shows a whole structure of the descender 33, as shown in FIG. 4, in a form used in fluid analysis of the fluid analysis unit 233. FIG. 10C shows a structure of a portion of the descender 33 corresponding to a nozzle 8 formed through the nozzle plate 30. The left end of FIG. 10B is a portion connected with the pressure chamber 10, and the right end corresponds to the nozzle 8.

The portion of the descender 33 used in the fluid analysis unit 233, from the left end to the nozzle 8, is divided into four regions. The inner diameters of the regions are represented by D1, D2, D3, and D4 in the order from the left end. The regions are concentric vertically in FIG. 10B. The horizontal lengths of the regions in FIG. 10B are represented by L1, L2, L3, and L4 in the order from the left end.

The portion of the descender 33 corresponding to the nozzle 8 is divided into two regions. The first region from the right has its inner diameter represented by D5 and its horizontal length represented by L6. The second region from the right has a tapered structure tapered rightward. The left end of the first region coincides with the right end of the second region. The inner surfaces of the second and first regions form an angle theta in FIG. 10C. The whole horizontal length of the regions corresponding to the nozzle 8 is represented by L5. In the analysis of the present invention, numeric values in the following Tables 1 and 2 are used for D1 to D5, L1 to L6, and theta. The unit for D1 to D5 and L1 to L6 is micrometer, and the unit for theta is degree.

TABLE 1

| Inner diameter [μm] | | Length [μm] | |
|---|---|---|---|
| D1 | D2 | L1 | L2 |
| 200 | 250 | 500 | 150 |
| D3 | D4 | L3 | L4 |
| 200 | 150 | 100 | 50 |

TABLE 2

| D5 | L5 | L6 | θ |
|---|---|---|---|
| 20 μm | 50 μm | 10 μm | 8 deg |

The fluid analysis was performed in the fluid analysis unit 233 using the above-described structure of the descender 33 by the quasi compressibility method as a fluid analysis method formulated by quasi compressibility. The quasi compressibility method is a method for obtaining velocity and pressure by making the Navier-Stokes equation simultaneous with an equation of continuity in which a term representing a quasi time change in density has been added. By the fluid analysis in the fluid analysis unit 233, the volume velocity of ink passing through the fluid analysis unit 233 was obtained.

The compliance of the pressure chamber 10, which is an acoustic capacitance C corresponding to the capacitance of the capacitor 210 in the equivalent circuit, was obtained by a relational expression C=W/Ev, where W represents the volume of the pressure chamber 10 and Ev represents the volume elasticity of ink.

The inertance of the aperture 12, corresponding to the inductance of the coil 212*a* in the equivalent circuit, was obtained by a relational expression m=rho×l/A, where rho represents the ink density; A represents the area of a section of the aperture 12 perpendicular to a longitudinal axis of the aperture, that is, horizontal in FIG. 4; and l represents the length of the aperture 12 horizontal in FIG. 4.

The passage resistance of the aperture 12, corresponding to the resistance R of the resistor 212*b*, was obtained as follows. In the above-described embodiment, each aperture 12 has a rectangular shape having its sides of a length of 2*a* and sides of a length of 2*b*, in a sectional view perpendicular to a longitudinal axis of the aperture, that is, horizontal in FIG. 4. In this case, the quantity of ink flowing in the aperture 12 is obtained by the following Expression 1. The relation between the pressure delta p to be applied in the aperture 12, corresponding to the amplitude of the pressure wave, and the quantity Q of ink flowing in the aperture 12, is expressed by Q=delta p/R. The resistance R is calculated from the relation and Expression 1. In Expression 1, l represents the length of the aperture 12, as described above.

$$Q = \frac{4ab^3\Delta p}{3\mu l}\left[1 - \frac{192b}{\pi^5 a}\sum_{n=1,3,\ldots}^{\infty}\frac{1}{n^5}\tanh\left(\frac{n\pi a}{2b}\right)\right] \quad \text{[Expression 1]}$$

A pressure source 299 supplies a pressure in the equivalent circuit. The pressure supplied by the pressure source 299 corresponds to the pressure to be applied to ink in the pressure chamber 10 by the piezoelectric actuator 50. The pressure to be applied to ink in the pressure chamber 10 by the piezoelectric actuator 50 is applied by deformation of the piezoelectric actuator 50. The degree of deformation of the piezoelectric actuator 50 depends on the difference in potential between the individual electrode 35 and the common electrode 34. Therefore, the pressure to be applied to ink varies in accordance with the waveform, for example, the waveform 61 in FIG. 7, of a voltage pulse signal applied to the individual electrode 35. In this analysis, it was supposed that voltage pulse signals of the waveform 61 were supplied to the piezoelectric actuator 50 under conditions that the values of the potential U0 were 18 V (volt), 19V, and 20V. In addition, the pulse width To was set to each length from 5 microseconds to 8.8 microseconds. In the practical range of the piezoelectric actuator 50, the quantity of deformation of the piezoelectric actuator 50 is in proportion to the potential U0 of the voltage pulse signal Therefore, it is supposed that the pressure to be applied by the pressure source is proportional to the potential U0.

Under the above-described conditions, the volume velocity of ink flowing through the circuit was obtained by numeric analysis on the basis of the pressure P, the acoustic capacitance, the inertance, and the resistance; and analysis results in the fluid analysis unit obtained by separate numeric analysis. The following Table 3 shows results of the numeric analysis of the volume velocity of ink.

TABLE 3

| To/Tc | Voltage1 | Voltage2 | Voltage3 | Voltage sensitivity [m/sec/V] |
|---|---|---|---|---|
| 0.340 | 2.94 | 3.18 | 4.14 | 0.599 |
| 0.360 | 3.17 | 3.77 | 4.88 | 0.859 |
| 0.370 | 3.76 | 4.57 | 5.23 | 0.733 |
| 0.380 | 4.65 | 4.81 | 5.61 | 0.483 |
| 0.400 | 4.96 | 5.14 | 6.27 | 0.656 |
| 0.410 | 5.19 | 5.34 | 6.63 | 0.720 |
| 0.420 | 5.56 | 5.78 | 6.82 | 0.627 |
| 0.440 | 5.80 | 6.10 | 7.95 | 1.08 |
| 0.450 | 5.75 | 6.52 | 9.42 | 1.84 |
| 0.470 | 6.01 | 7.32 | 10.1 | 2.05 |
| 0.480 | 6.67 | 8.31 | 10.2 | 1.77 |
| 0.490 | 7.36 | 8.35 | 9.60 | 1.12 |
| 0.510 | 7.13 | 8.03 | 8.69 | 0.780 |
| 0.520 | 7.04 | 7.62 | 8.36 | 0.660 |
| 0.530 | 7.39 | 7.82 | 8.73 | 0.670 |
| 0.550 | 7.36 | 7.96 | 9.28 | 0.962 |
| 0.560 | 6.91 | 8.18 | 9.70 | 1.39 |
| 0.580 | 6.29 | 7.51 | 9.44 | 1.58 |
| 0.590 | 5.94 | 6.64 | 8.07 | 1.06 |
| 0.600 | 5.79 | 6.21 | 6.76 | 0.483 |

In Table 3, the first column from the left shows the values of To/Tc to the respective values of To set in this analysis. In this analysis, Tc=14.6 microseconds.

In Table 3, the second to fourth columns from the left show ink ejection speeds to each value of To/Tc when the values of U0 are Voltages 1 to 3, respectively. That is, the analysis was carried out for cases wherein the individual electrode 35 was supplied with voltage pulse signals of waveforms 61 in which To/Tc had the respective values shown in the first column and U0 had the respective values of Voltages 1 to 3. The second to fourth columns of Table 3 show the ink ejection speeds obtained by the analysis for the respective cases. Voltages 1 to 3 were 18 V, 19 V, and 20 V, respectively. The unit for the ink ejection speed is m/sec.

In Table 3, the fifth column from the left shows the values of voltage sensitivity to the respective values of To/Tc. The voltage sensitivity is an index that indicates the degree of a change in ejection speed when the value of U0 changes at each value of To/Tc. The unit of the voltage sensitivity is m/sec/V. The voltage sensitivity is specifically defined as follows. U0 is used as the value of x and the ink ejection speed is used as the value of y, and the results of the second to fourth columns of Table 3 to each value of To/Tc are plotted on an xy-coordinate system. Thereby, three points corresponding to the respective ejection speeds for Voltages 1 to 3 are plotted to each value of To/Tc. The voltage sensitivity corresponds to the gradient of a regression line given for the points thus plotted.

Figure 11A:
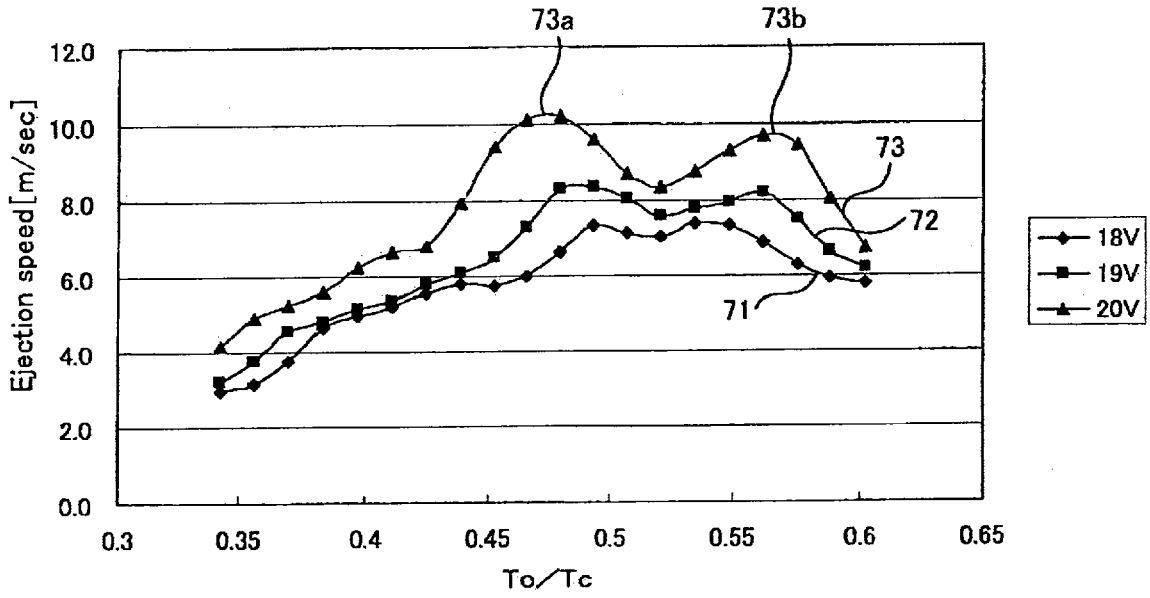
FIGS. 11A and 11B are graphs showing results of numeric analysis performed by using the model shown in FIGS. 10A to 10C.
Figure 11B:
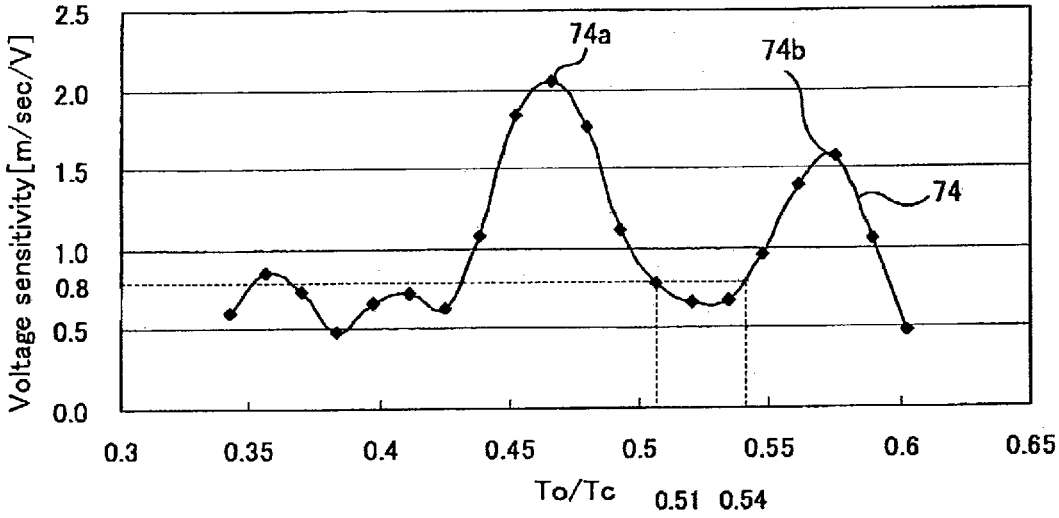

FIGS. 11A and 11B are graphs showing the results of Table 3. In FIG. 11A, curved lines 71 to 73 are obtained by plotting the ink ejection speeds to the values of To/Tc in relation to the respective values of Voltages 1 to 3, on the basis of the results of the second to fourth columns of Table 3. In FIG. 11A, the axis of abscissas represents the value of To/Tc, and the axis of ordinate represents the ejection speed. In FIG. 11B, a curved line 74 is obtained by plotting the values of voltage sensitivity to the values of To/Tc, on the basis of the result of the fifth column of Table 3. In FIG. 11B, the axis of abscissas represents the value of To/Tc, and the axis of ordinate represents the voltage sensitivity.

Any of the curved lines 71 to 73 has its general shape convex upward, and it is similar to the curved line 70 in this feature. On the other hand, while only one maximal value appears on the curved line 70, some maximal values appear on any of the curved lines 71 to 73. For example, peaks 73*a* and 73*b* appear on the curved line 73. Also on each of the curved lines 71 and 72, peaks appear at positions corresponding to those on the curved line 73 though they are somewhat shifted. It is thinkable that the reason why such a curved line for ejection speed is generally convex upward as a whole but takes a number of maximal values, is that local proper oscillation having a proper oscillation period smaller than Tc is generated in each portion of the individual ink passage 32, such as the descender 33.

As shown by the curved line 74, the voltage sensitivity also takes a number of maximal values. The positions of peaks 74*a* and 74*b* where the voltage sensitivity takes maximal values correspond to the positions of the peaks 73*a* and 73*b* on the curved line 73, respectively. Thus, FIGS. 11A and 11B show that positions where the voltage sensitivity increases correspond to the respective positions where the ejection speed takes maximal values. For example, while a maximal value appears on the curved line 74 near To/Tc=0.58, a maximal value appears also on the curved line 73*b* near To/Tc=0.56, which is close to the position where the maximal value appears on the curved line 74.

On the other hand, an increase in voltage sensitivity corresponds to an increase in the change in ejection speed relative to a change in voltage. Because the value of the voltage corresponds to the value of the potential U0 of the voltage pulse signal supplied to the individual electrode 35, a change in the voltage corresponds to a change in the degree of deformation of the piezoelectric actuator 50. Therefore, the fact that an increase in voltage sensitivity brings about an increase in the change in ejection speed, means that the change in ejection speed increases as the change in the degree of deformation of the piezoelectric actuator 50 increases.

Here, an index Dv, in a unit of m/s, that interrelates variation in the degree of deformation of the piezoelectric actuator 50 and variation in ejection speed, is derived as the following Expression 2.

$$Dv=Sv\times U0\times Dd \qquad \text{[Expression 2]}$$

In Expression 2, Dd represents the rate of variation in the degree of deformation of the piezoelectric actuator 50. When a signal of the waveform 61 of FIG. 7 is supplied to the piezoelectric actuator 50, the degree of deformation of the piezoelectric actuator 50 is substantially in direct proportion to U0. Therefore, the value of U0×Dd is in direct proportion to variation in the degree of deformation of the piezoelectric actuator 50. Thus, the value of U0×Dd serves as an index that indicates the variation in the degree of deformation of the piezoelectric actuator 50. In Expression 2, Sv represents the voltage sensitivity to indicate the degree of a change in ejection speed relative to a change in U0.

Thus, the value of Dv=Sv×U0×Dd serves as an index that indicates variation in ink ejection speed when there is variation in the degree of deformation of the piezoelectric actuator 50. The degree of deformation of the piezoelectric actuator 50 corresponds to the maximum deformation quantity G of the piezoelectric actuator 50 when the piezoelectric actuator 50 is deformed downward in FIG. 8A.

The following Table 4 shows results of calculation of Dv calculated on the basis of Expression 2 to values of Sv and values of Dd. In Table 4, the first column from the left shows values of Sv. The uppermost row of the second to fifth columns shows values of Dd. The rows below the uppermost row show values of Dv to the respective values of Sv and the respective values of Dd. In the calculation of Dv, U0 of 19 V was used as a mean voltage.

TABLE 4

| Voltage sensitivity | Dd(mean value) | | | |
|---|---|---|---|---|
| [m/s/V] | 0.0300 | 0.0500 | 0.0700 | 0.100 |
| 0.300 | 0.171 | 0.285 | 0.399 | 0.570 |
| 0.400 | 0.228 | 0.380 | 0.532 | 0.760 |
| 0.500 | 0.285 | 0.475 | 0.665 | 0.950 |
| 0.600 | 0.342 | 0.570 | 0.798 | 1.14 |
| 0.700 | 0.399 | 0.665 | 0.931 | 1.33 |
| 0.800 | 0.456 | 0.760 | 1.06 | 1.52 |
| 0.900 | 0.513 | 0.855 | 1.20 | 1.71 |
| 1.00 | 0.570 | 0.950 | 1.33 | 1.90 |
| 1.10 | 0.627 | 1.05 | 1.46 | 2.09 |
| 1.20 | 0.684 | 1.14 | 1.60 | 2.28 |
| 1.30 | 0.741 | 1.24 | 1.73 | 2.47 |
| 1.40 | 0.798 | 1.33 | 1.86 | 2.66 |
| 1.50 | 0.855 | 1.43 | 2.00 | 2.85 |
| 1.60 | 0.912 | 1.52 | 2.13 | 3.04 |
| 1.70 | 0.969 | 1.62 | 2.26 | 3.23 |
| 1.80 | 1.03 | 1.71 | 2.39 | 3.42 |
| 1.90 | 1.08 | 1.81 | 2.53 | 3.61 |
| 2.00 | 1.14 | 1.90 | 2.66 | 3.80 |

In general, the rate of variation in the degree of deformation of the piezoelectric actuator 50 is averagely about plus or minus 7%. On the other hand, when the index Dv for variation in ejection speed exceeds 1.0 m/s, in many cases, the reproducibility of an image to be printed is beyond the bounds of practical permissibility. Therefore, from Table 4, it is understood that the range in which the image to be printed does not have the problem is the rang in which the voltage sensitivity does not exceed 0.8 m/s/V, that is, the rang from 0 m/s/V to 0.7 m/s/V. On the other hand, from Table 3 and FIG. 11B, it is understood that the value of To/Tc that causes the voltage sensitivity to fall within the above range is within the range from 0.51 to 0.54 when the value of To/Tc is within the rang of not less than ½. Therefore, in order to maintain the quality of an image to be printed when ink is ejected with the value of To/Tc being within the rang of not less than ½, the value of To/Tc must be within the range from 0.51 to 0.54. When the value of To/Tc is 0.6, it also causes the voltage sensitivity to fall the above range. However, when To is too large, the efficiency of energy actually consumed for ink ejection reduces relative to the energy supplied for ink ejection. Therefore, the value of To/Tc in the range of not less than 0.6 is unsuitable for ink ejection.

From the above-described analysis, it was understood that the above-described problem is dissolved when the actuator is controlled such that the value of To/Tc falls within the range from 0.51 to 0.54.

When the sub manifold channel 5*a* that functions as the common ink chamber and the pressure chamber 10 are opposed to each other, and the sub manifold channel 5*a* is disposed in between the pressure chamber 10 and the lower face of the passage unit on which ejection ports are formed, as in the above-described embodiment, the above-described problem is apt to arise.

More specifically, when the sub manifold channel 5*a* is disposed in between the pressure chamber 10 and the lower face of the passage unit 4, that is, the ejection face, the descender 33 leading from the pressure chamber 10 to the nozzle 8 formed on the lower face of the passage unit 4 must extend over the sub manifold channel 5*a*. Therefore, the descender 33 must be long in comparison with a case wherein the sub manifold channel 5*a* is not disposed in between the pressure chamber 10 and the lower face of the passage unit 4. As a result, when proper oscillation is generated in the descender 33, the influence of the proper oscillation is large. When the influence of the proper oscillation is large, the problem that variation in ink ejection speed increases relatively to variation in the degree of actuator deformation, is apt to arise. That is, when the control of the actuator according to the present invention is applied to an inkjet head having the same construction as the above-described embodiment, the effect is considerable in comparison with a case wherein the control is applied to an inkjet head having its construction in which the problem is originally hard to arise.

In addition, when a portion of the descender 33 near the boundary with the pressure chamber 10 is narrower than a longitudinally middle portion of the descender 33, as in the above-described embodiment, local proper oscillation is apt to be generated in the descender 33. Therefore, when the present invention is applied to this case, the effect is considerable in comparison with a case wherein the present invention is applied to an inkjet head having its construction in which such local oscillation is originally hard to be generated.

In addition, when a longitudinally middle portion of the partial passage leading from the outlet of the sub manifold channel 5*a* to the pressure chamber 10 is narrower than either of portions of the partial passage near the boundary with the pressure chamber 10 and near the sub manifold channel 5*a*, as in the above-described embodiment, proper oscillation in which one of the positions of the partial passage is one end to reflect, is apt to be generated. Therefore, an inkjet head suitable for ink ejection by the fill-before-fire method is realized.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a passage unit comprising a common ink chamber and an individual ink passage leading, from an outlet of the common ink chamber via a pressure chamber to an ink ejection port;

an actuator that can selectively take a first state in which the volume of the pressure chamber is V1 and a second state in which the volume of the pressure chamber is V2 larger than V1; and a controller that controls the actuator to change from the first state into the second state and then change back into the first state to eject ink from the ejection port, the individual ink passage configured to satisfy both of the following conditions:

(a) a curved line representing a change in the ejection speed of ink to be ejected from the ejection port, relative to a change in the time period To from a time point at which the actuator starts to change from the first state into the second state, to a time point at which the actuator starts to change from the second state into the first state, when the actuator changes from the first state into the second state and then changes back into the first state to eject ink from the ejection port, has a general shape being convex in the direction of the ejection speed increasing; and (b) the ink ejection speed attains a first maximal value on the curved line in a region in which To is larger than ½ times the period Tc of proper oscillation of ink filling up the individual ink passage and the ink ejection speed attains a second maximal value in a region in which To is less than ½ times the period Tc, and the ink ejection speed attains a minimal value in a region on the curved line between the first maximal value and the second maximal value, wherein the controller controls the actuator such that the value of To/Tc falls within a range from 0.51 to 0.54, and the minimal value on the curved line is in a region in which the value of To/Tc falls within a range from 0.51 to 0.54.

2. The apparatus according to claim 1, wherein the common ink chamber and the pressure chamber are opposed to each other, and the ejection port is formed on an ejection face of the passage unit, which face is disposed on the opposite side of the common ink chamber from the pressure chamber.

3. The apparatus according to claim 1, wherein the area of a section of a region of a first partial passage of the individual ink passage leading from an outlet of the pressure chamber to the ejection port, perpendicular to a longitudinal axis of the first partial passage, is larger than either of the area of a boundary between the first partial passage and the pressure chamber and the area of the ejection port.

4. The apparatus according to claim 1, wherein the area of a section of a region of a second partial passage of the individual ink passage leading from the outlet of the common ink chamber to the pressure chamber, perpendicular to a longitudinal axis of the second partial passage, is smaller than either of the area of a boundary between the second partial passage and the pressure chamber and the area of the outlet of the common ink chamber.

* * * * *